United States Patent [19]

Vogel

[11] 4,109,477

[45] Aug. 29, 1978

[54] OFFSHORE DRILLER RIG

[75] Inventor: Rudolf Vogel, Salzgitter-Bad, Germany

[73] Assignee: Salzgitter Maschinen AG, Salzgitter, Germany

[21] Appl. No.: 639,836

[22] Filed: Dec. 11, 1975

Related U.S. Application Data

[63] Continuation of Ser. No. 550,725, Feb. 18, 1975, abandoned.

[30] Foreign Application Priority Data

Feb. 18, 1974 [DE] Fed. Rep. of Germany ..... 2407655

[51] Int. Cl.[2] ..... E02D 17/00; E02D 27/42

[52] U.S. Cl. ..... 61/87; 61/94; 61/97; 61/98; 61/99; 61/100; 61/53.74

[58] Field of Search ..... 61/86, 97, 89, 98, 99, 61/100, 87, 94

[56] References Cited

U.S. PATENT DOCUMENTS

| | | | |
|---|---|---|---|
| 2,579,703 | 12/1951 | Rutledge et al. | 61/88 |
| 2,589,146 | 3/1952 | Samuelson | 61/90 |
| 2,600,761 | 6/1952 | Halliburton | 61/91 |
| 2,924,947 | 2/1960 | Peterson | 61/99 |
| 2,941,369 | 6/1960 | Quirin | 61/99 |
| 2,967,400 | 1/1961 | Grant et al. | 61/91 |
| 2,986,889 | 6/1961 | Ludwig | 61/94 |
| 3,815,372 | 6/1974 | Mott | 61/93 |
| 3,824,795 | 7/1974 | Mo | 61/87 |

*Primary Examiner*—Jacob Shapiro
*Attorney, Agent, or Firm*—Michael J. Striker

[57] ABSTRACT

A platform is arranged on one or more separate frameworks. Each of the frameworks is provided with a plurality of downwardly extending hollow legs. Each of the legs has a lower end and its interior is accessible from the platform at its upper end. A plurality of ballastable floats together at least furnish a part of the buoyancy required to maintain the framework structure afloat preliminary to its anchoring on the ocean bottom; each of the floats is mounted at one of the lower ends of the legs and has a bottom wall and a deformable skirt surrounding the bottom wall and depending downwardly beyond the same. A spider-like unit is provided at each of the floats and adapted to discharge pressure medium against the ocean bottom beneath the float when the latter is proximal to or rests upon the ocean bottom. The interior of each leg is connectable with the interior of the associated float and with the space beneath the float so that ballasting material, such as split rock or the like, can be pored through the leg onto the ocean bottom beneath the float, and also ultimately fill up the float and possibly also the leg; this material can be supplied from the upper platform.

108 Claims, 37 Drawing Figures

FIG.1
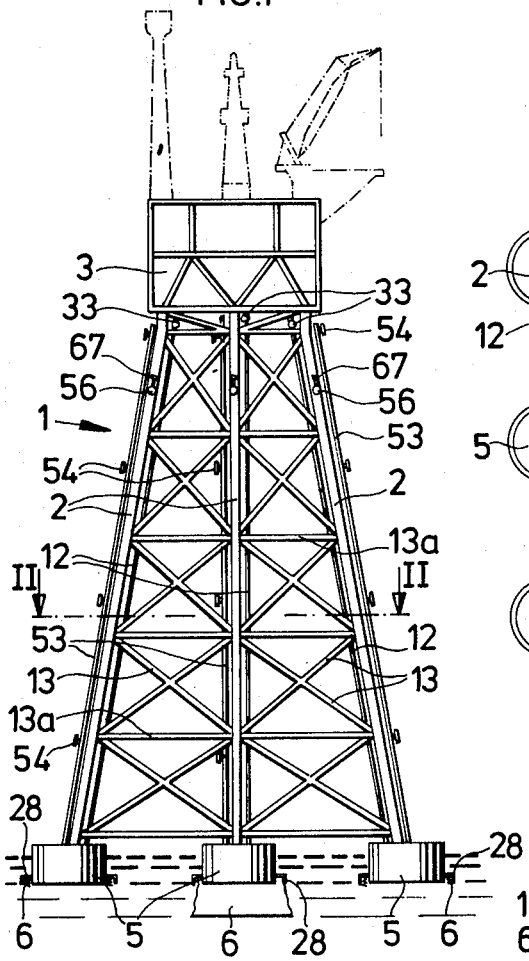
FIG.2
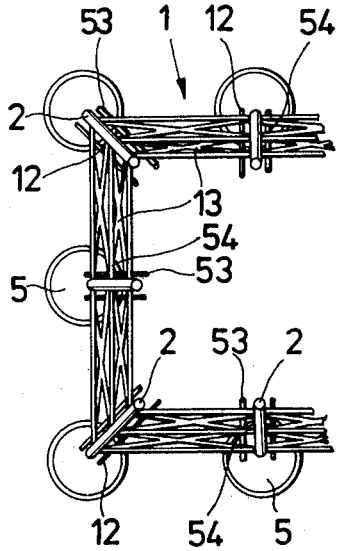
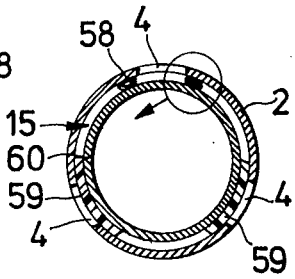
FIG.4
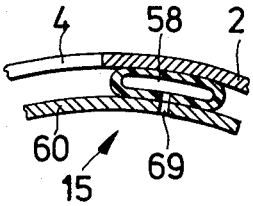
FIG.5

FIG. 3
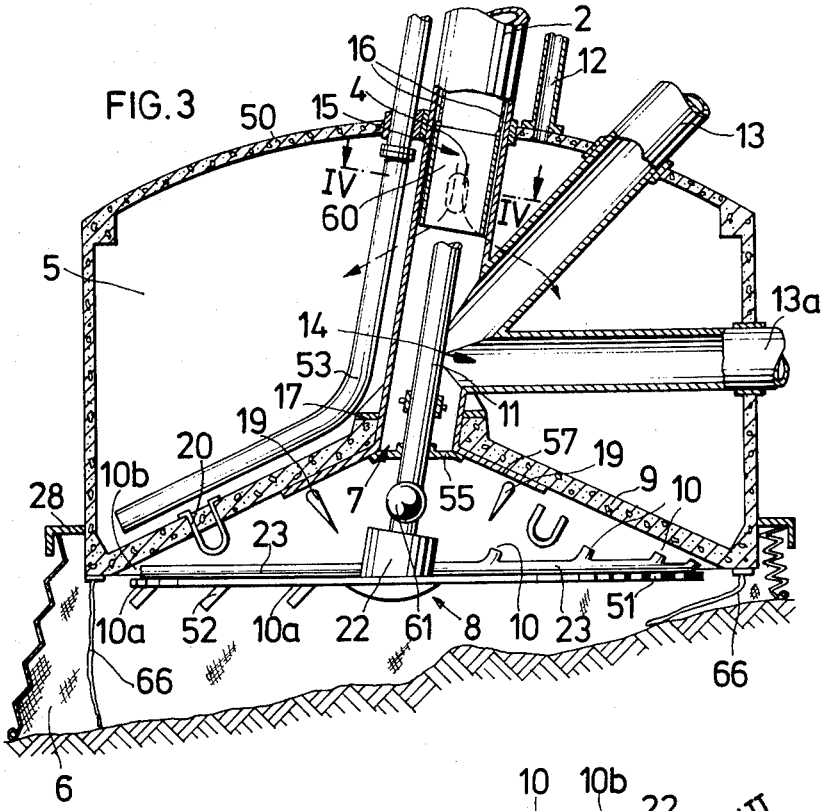
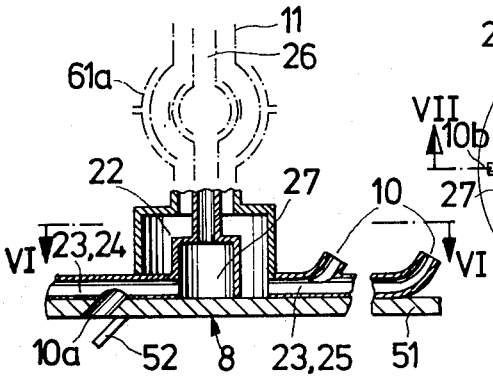
FIG.7
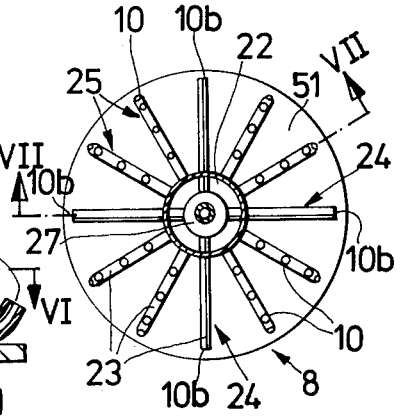
FIG.6

FIG.9
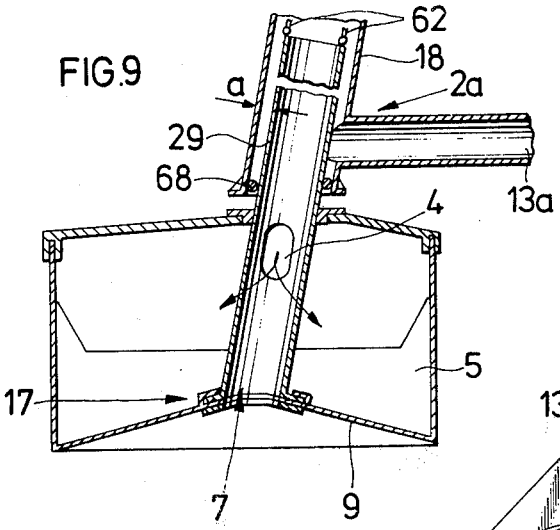
FIG.11
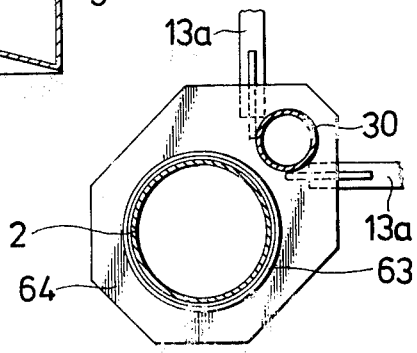
FIG.10
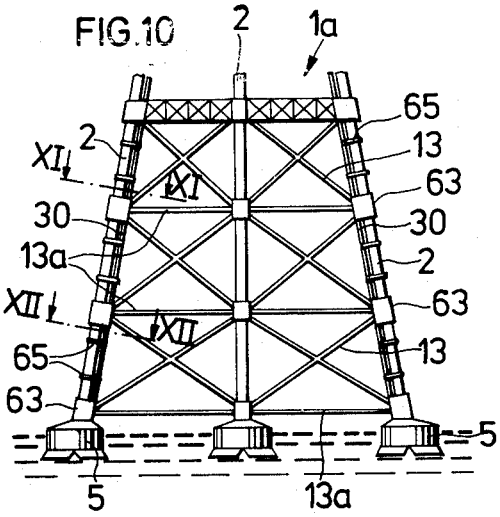
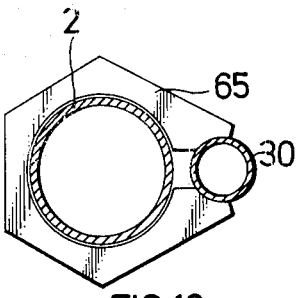
FIG.12

FIG.18
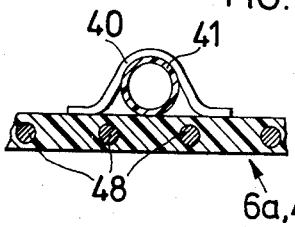
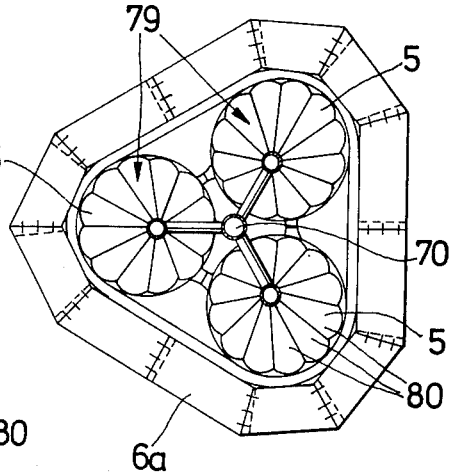
FIG.20
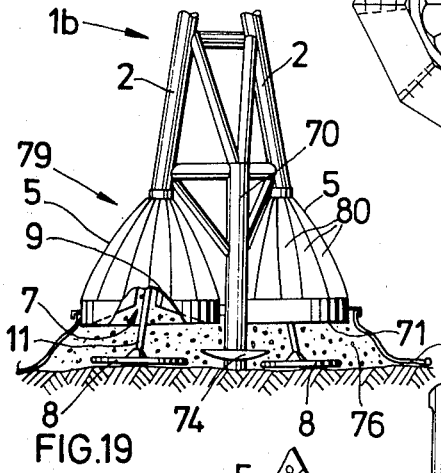
FIG.19
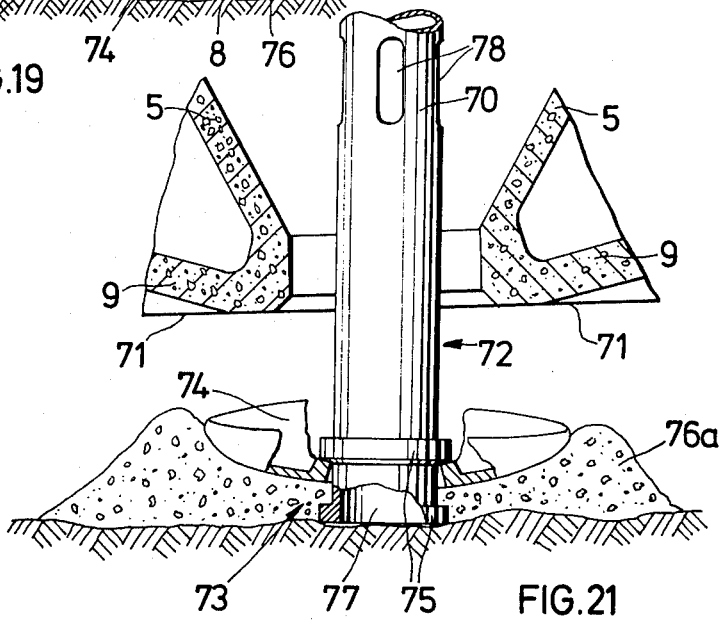
FIG.21

FIG.25
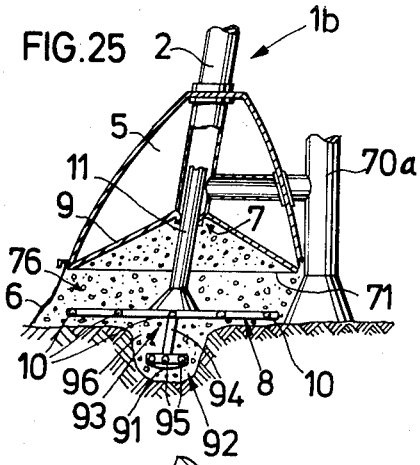
FIG.28
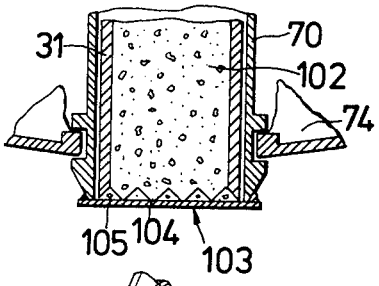
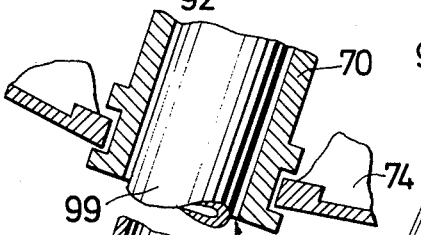
FIG.29
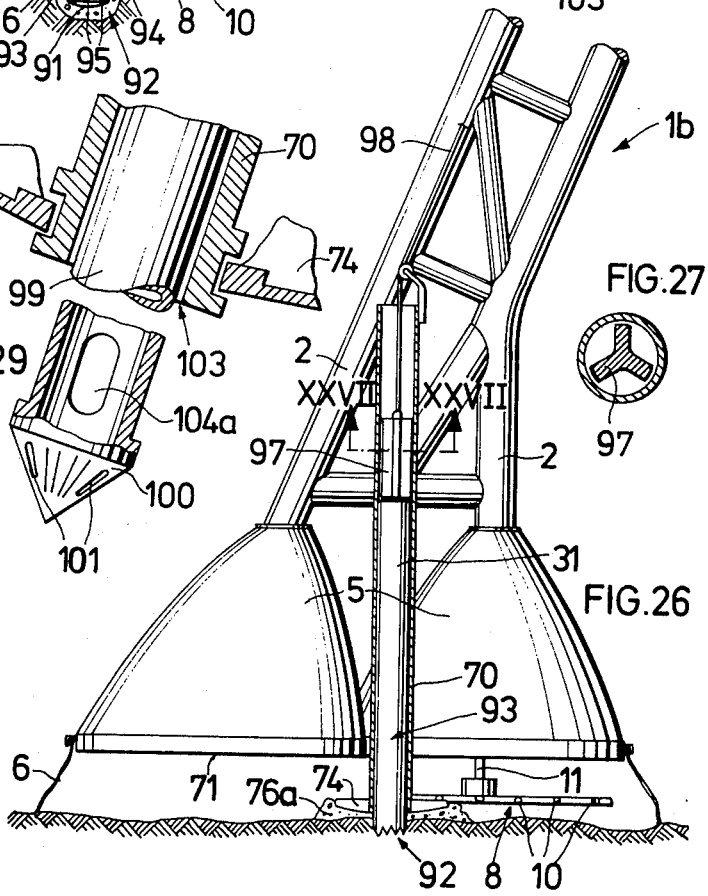
FIG.27
FIG.26

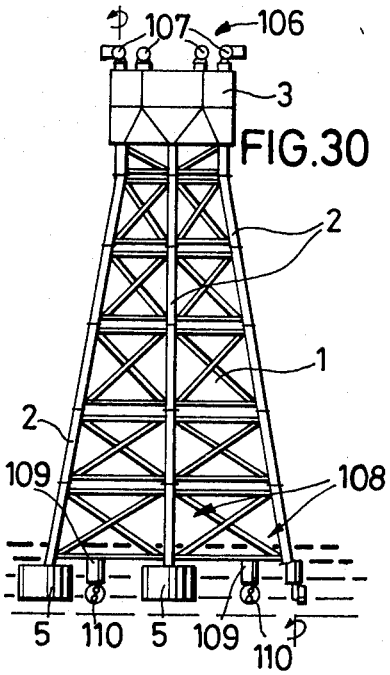
FIG.30
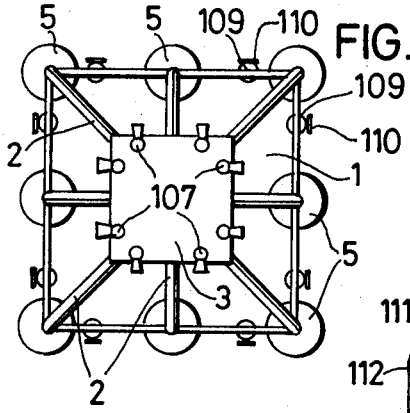
FIG.31
FIG.32
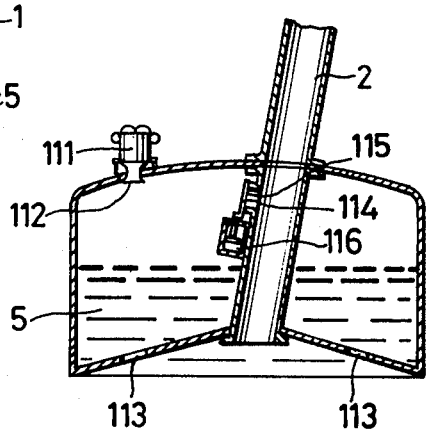

OFFSHORE DRILLER RIG

This is a continuation of application Ser. No. 550,725, filed Feb. 18, 1975, now abandoned.

BACKGROUND OF THE INVENTION

This invention is concerned with an offshore drilling rig, and more particularly with the type of offshore drilling rig which is to be supported on the ocean bottom.

Offshore drilling rigs are huge structures which, as their name indicates, are located off shore in the ocean and are in most cases employed to drill for oil in the continental shelf. Certain of these rigs are of the type that float; others are of the type having legs which extend through the water to the ocean bottom and are there anchored in suitable manner; at the top the legs carry a working platform that is elevated above the level of the ocean. The present invention is concerned with the latter type of drilling rig.

It is known from the prior art (compare "Steel Times," December, 1973, page 859) to form an underwater platform on the ocean bottom, and to mount the legs of the drilling rig on this platform. In order to assure that the platform will be properly and uniformly supported and not be subject to undesirable stresses, it is necessary to grade the ocean bottom before the platform can be installed.

Another prior-art proposal suggests to drive bundles of timber or steel girders into the ocean bottom around the lower ends of the supporting legs of the rig; the timber or the girders may be driven to a depth of up to 90 meters. Of course, to drive these elements into the ocean bottom, it is necessary to carry out extensive underwater operations, which are expensive.

Another problem encountered in connection with the prior art is the manner in which the drilling rig is moved to its ultimate place of use. It is conventional (compare the periodical "Meerestechnik," Germany, 1973, No. 6, pages 207 ff) to assemble the framework structure of such rigs, including the legs, in a horizontal position in dry docks or wharves; upon completion of the assembly they are then towed in horizontal position to the installation site where they are moved to upright position and anchored. The towing and the change from horizontal to upright position requires special flotation devices and is complicated.

SUMMARY OF THE INVENTION

It is an object of the present invention to overcome the disadvantages of the prior art.

More particularly, it is an object of this invention to provide an improved offshore drilling rig which can be assembled completely or substantially completely on land and can be readily transported to the site of installation.

Another object of the invention is to provide such an improved drilling rig which, once it has been moved to the site of installation, can be lowered into engagement with the ocean bottom, and anchored thereon, in a substantially simpler manner than was possible heretofore.

In keeping with these objects, and with others which will become apparent hereafter, one feature of the invention resides in an offshore drilling rig which, briefly stated, comprises at least one upright framework structure provided with an upper platform and with a plurality of downwardly extending hollow legs, each leg having a lower end and an upper end through which its interior is accessible from the platform. A plurality of ballastable floats together furnish at least part of the buoyancy required to maintain the framework structure afloat preliminary to anchoring on the ocean bottom; each of these floats is mounted at one of the lower ends and has a bottom wall and a deformable skirt surrounding the bottom wall and depending downwardly beyond the same. Dispensing means is provided at the respective floats and has a plurality of apertures located below the bottom wall of the respective float for dispensing of flowable material. Means is provided for communicating the interior of each leg with the interior of the associated float and with the region beneath the bottom wall of the float.

Means is provided for maintaining a uniform floating position and suspended position of the framework structure in the water.

The drilling rig according to the present invention may be either produced in vertical orientation on land, that is in upright position, and then towed to the site of installation and lowered onto the ocean bottom, or it may have a plurality of framework structures which are connected with the upper platform and which can be moved relative to the upper platform between a horizontal and an upright position for installation purposes.

Since each of the rigs is now provided with an individual ballastable float, the drilling rig according to the present invention has a substantially greater base area for its support than was previously the case. This means that smaller amounts of ballast are required than previously, or that an increased stability is obtained if the same of ballast is used as previously.

Moreover, the present invention substantially improves the flotation stability of the drilling rig when the latter is being towed in upright position, since the necessary metacentric height can be precisely determined and selected merely by moving the floats apart, for which purpose the legs can be spread or moved closer together, and this can be accomplished without any significant increase in expenses. The flotation devices provide additional assurance against undesired tilting of the rig while it floats on the water and during its descent through the water for support on the ocean bottom. Of course, if the rig is of the type having a platform and a plurality of framework structures which can be pivoted relative to the platform, or vice versa, no tendency towards tilting will develop since the platform will be floated to the site of installation in a flat horizontal condition and the installation is affected by pivoting the framework structures to upright position.

The present invention assures that the manufacture and assembly of the novel drilling rig can be effected on land, and the drilling rig can be completed to the point where it is fully or substantially operational. Additional complicated floating arrangements are as a rule not necessary to move the rig from land to its site of installation, and it is absolutely unnecessary to grade the ocean bottom in preparation for the installation of the rig. The installation time itself is reduced to a minimum since the rig is substantially completed on land and it is merely necessary to carry out the foundation work at the site. The supply of the material for the foundation can be effected through the hollow legs of the rig from the upper platform itself. One of the advantages obtained in this manner is the fact that the precalculated costs of building and installing such a rig can be much more precisely met than in the prior art, because—inter alia—an interruption of the work during foul weather—which can as a rule be expected to be encountered at the installation site—is not necessary when the rig is being fully or substantially fully assembled on land.

When the rig is being made to descend onto the ocean bottom, it is particularly advantageous if an air conduit is provided which can be closed by means of a valve and extends upwardly from the highest point of the interior of the ballastable floats and towards the surface, and if a flooding conduit is provided which communicates with the lowest point of the respective float and can be connected with an adjustable source of flooding water; the flooding conduit advantageously extends along the leg associated with the respective float to or to the vicinity of the upper platform, and may be provided with longitudinally spaced inlets that can be sealed.

With such a construction, the flooding or ballasting of the floats, and the venting of the floats can be precisely accommodated to one another. These functions can be controlled by armatures such as valves and the like which are freely accessible during the lowering of the rig onto the ocean bottom, so that a remote control or underwater repair in the event of malfunction, is not necessary.

By providing means for communicating with the interior of each float with the interior of the associated leg, and with the region beneath the bottom wall of the float, it is a simple matter to admit ballasting material such as rocks or the like through the floats to the ocean bottom beneath the respective float, and also to admit such material for the purpose of filling the respective floats with it. The framework structure will be provided with cross braces, some or all of which may be of tubular character. The legs and those of the cross braces which are tubular serve to increase the buoyancy of the framework structure during the lowering of the same onto the ocean bottom. During the operation, the opening in the bottom wall of the respective float, which constitutes a part of the means for communicating the interior of the float with the region beneath the bottom wall of the float, is advantageously closed by a cover which seals this opening but which can be dropped when the time comes to provide communication with the region beneath the bottom wall. Of course, after the framework structure is in place on the bottom wall, it may be desirable to be able to flood both the legs and any cross braces that are tubular, and for this purpose one or more of the legs may be provided with holes that can be closed and that will be beneath the water level when the framework structure is supported on the ocean bottom, so that these holes need merely be opened to admit ballasting water.

The bottom wall of the respective floats is advantageously upwardly conical, thus defining a substantially conical hollow beneath the float together with the ocean bottom on which the float rests after the framework structure has been lowered onto the ocean bottom. When subsequently foundation-forming material, such as rocks or the like, is poured or otherwise supplied through the float and into this space, it will fill this space. It will now be appreciated why the skirt is provided according to the present invention since this skirt surrounds the float and prevents the material from escaping.

A particularly good anchoring of the rig can be obtained if a rigid connection is effected between each leg and the associated float by means of a large-dimensioned flange, and if the bottom wall of each float is provided with downwardly extending spikes, ropes and other anchoring elements, which become surrounded by the rock or other ballasting material admitted via the leg into and through the float, and which subsequently become firmly embedded when all of this ballasting material is united into a unitary block by the addition of underwater concrete.

It is known that the ocean bottom at most locations is covered by a layer of silt or mud. Since this will tend to interfere with proper anchoring of the rig on the bottom, it is desirable to be able to flush away the silt or mud before the anchoring operations begin. For this purpose, the dispensing means may be utilized which can direct streams of pressurized flowable material, e.g., water, against the ocean bottom to thereby flush the silt or mud out of the way. Advantageously the dispensing means will have a spider-like structure of tubular elements connecting with a central distributor which extends through the associated leg and can be used to raise and lower the spider-like structure relative to the ocean bottom. The tubular members are preferably arranged in form of two groups radiating from the central distributor, and of which one has discharge apertures directed upwardly whereas the group has discharge apertures directed downwardly and radially outwardly. Such an arrangement can be used not only for the initial flushing away of silt or mud with the aid of streams of pressurized water, but subsequently can be used to inject streams of flowable concrete into the foundation-forming material located beneath the bottom of the respective float, and these streams will not only be directed downwardly and outwardly but also upwardly to obtain a homogeneous penetration and distribution of the flowable cement throughout the foundation-forming material which it is to connect into a unitary block.

For purposes of flushing away silt or mud, it is particularly advantageous if the spider-like structure can be turned, for example by making the conduit which supplies it with the flowable material and which extends through the associated leg in upward direction, itself turnable. This conduit may, incidentally, also be used as a structural member which is capable of temporarily supporting a part of the weight of the framework structure, for which purpose the conduit—which may also be shiftable lengthwise of the rig in order to raise or lower the spider-like structure—can be lowered within its leg so that the framework structure can be slightly raised off the ocean bottom during the admission of foundation-forming material to assure that this material can properly drop into and fill the space beneath the respective float.

According to one embodiment of the invention, it is possible to make provision for the water to be ejected from the spider-like structure only in downward direction, and for the flowable cement to be ejected only in upward direction. If this is desired, then the supply conduit for supplying the flowable material may have a second conduit extending through it with clearance which, just as the first-mentioned supply conduit, is accessible at the upper platform. This inner conduit can then lead to the second distributor located within the first-mentioned distributor and communicating with one of the groups of tubular members, whereas the other group is connected with the first-mentioned distributor. In that case, water can be supplied through one of the conduits to one group of tubular members of the spider-like structure, and cement in flowable condition can be supplied through the other conduit to the other group of tubular members.

The spider-like structure need not be located outside the float and beneath the bottom wall of the same; according to a further embodiment of the invention, it may also be located within the float and the bottom wall thereof may be provided with apertures with which outlet openings of the respective tubular members of the spider-like structure communicate in a sealed relationship, so that these outlet openings discharge through the apertures of the bottom wall of the float to the exterior of the latter. In this case, the tubular members of the spider-like structure communicate with a distributor for the flowable material which is located adjacent the lower end of the leg within the float, and from which the supply conduit extends upwardly along the leg and to the upper platform.

In order to compensate for any unevenness encountered in the ocean floor, the lower portions of the respective legs may be of telescopic construction. The inner tube of the telescopic construction may then be rigidly connected with the respective float and an arrangement may be provided for raising and lowering it relative to the outer tube of the leg, whereupon the clearance between the two tubes can be filled with cement which, when it has hardened, will maintain the inner and outer tubes of the leg against relative displacement.

Compensation for an uneven ocean bottom can also be obtained if the upright framework structure is composed of cross braces with upright structural members, and if the legs are mounted on these upright structural members so as to be displaceable relative thereto in longitudinal direction. It is also possible to mount the upper platform in such a manner that it can be adjusted in its position relative to the framework structure.

The skirts mentioned earlier have been identified as having the purpose of keeping together the foundation-forming material that has been poured through the respective leg and filled into the space beneath the float. However, they have additional purposes. Their lower free edges, or rather marginal portions of the skirts, overlie an annular area of the ocean bottom surrounding the respective float and in so doing prevent hollowing out of the ocean bottom adjacent the space which is filled with the foundation-forming material (and later with the unitary block) into which the foundation-forming material has been united by the injection of liquid concrete. This not only eliminates even slight hollowing out of the ocean bottom about the ballastable floats, but also—and as a result of this—greatly increases the safety of the rig. A particularly advantageous arrangement provides the lower marginal portion of the respective skirt with inflatable elements that are mounted on it and can be inflated to force the lower marginal portion to extend at an angle to the remainder of the respective skirt, analogous to the brim of a hat; this "brim" will then rest on the surrounding ocean bottom. It is advantageous if the width of the "brim" corresponds to approximately one-third of the base of the respective float. When the inflatable elements are not in inflated condition, then the entire skirt is advantageously rolled up so as to be located laterally of its associated float which it surrounds. It is advantageous if the skirt is composed of a plurality of segments since this facilitates its manufacture, mounting and subsequent deploying.

During the descent of the framework structure from the surface towards the ocean bottom, the skirt may be rolled up so as to offer comparatively little resistance to its passage through the water, thereby assuring that the skirt is not unnecessarily mechanically stressed. It is deployed, and in particular its "brim" is formed, only at the time at which this is necessary, that is after the framework structure is supported on the ocean bottom and the formation of the foundation is about to begin. Once the "brim" of the skirt engages the ocean bottom, it surrounds the associated float over so large an area that a possibly present undertow cannot exert any undesirable influences upon the foundation-forming material.

In the type of construction wherein inflatable elements are used in conjunction with the respective skirts, it is advantageous if they communicate with an annular fluid supply line mounted on the associated float and from which the inflatable elements extend radially or substantially radially. Thus, all of the elements can be inflated simultaneously and from a single supply line, greatly simplifying the construction.

Experiments have shown that it is particularly advantageous to use compressed air for the purpose of inflating these elements, since the use of such compressed air makes it possible to cause flotation of the "brim" of the skirt underwater and thus facilitates its inspection, for example by means of underwater cameras which are intended to ascertain that the "brim" has been properly deployed. Of course it will be appreciated that the purpose of providing the inflatable elements is merely to cause the "brim" to assume the desired orientation with reference to the remainder of the skirt; once the "brim" rests on the ocean bottom, the inflation of the inflatable elements is terminated. It is advantageous in this connection if the skirt is heavier than water when the inflatable elements are not inflated, so that it will rest on the ocean bottom, especially with its "brim," but that it is lighter than water when the inflatable elements are inflated to the full extent. In this manner, a partial inflation can be utilized in order to at any time (not only during the installation of the rig but also later for inspection purposes) cause the "brim" to temporarily lift off the ocean bottom (and perhaps to shake off silt or mud that has collected on it and makes it invisible) so that it can be inspected for damage and for proper positioning.

The skirt is advantageously of synthetic plastic sheet material with metal reinforcements embedded in it, and the inflatable elements may be hoses which are mounted by means of elastic brackets on that portion of the skirt which is to be deployed at the "brim". Weights may also be provided on the free edge of the skirt in order to further improve the protection offered by the "brim" against hollowing out of the ocean bottom underneath by currents or the like.

When the rig according to the present invention is being lowered towards the ocean bottom, great care must be exercised as the floats approach the ocean bottom. In fact, the descent of the framework structure must be stopped before the floats come in direct contact with the ocean bottom and the flushing away of silt or mud must be effected while the framework structure is still in floating condition. This is difficult to do and quite expensive. Also, once the site preparation has been carried out, that is once the mud or silt has been flushed away and the floats have been carefully lowered into contact with the ocean bottom, some types of floats may not be able to withstand the weight of the framework structure acting upon them, depending the particular characteristics of the ocean bottom at the point where the float rests upon the same. All of these problems are overcome according to a further concept of the invention, in that the framework structure is provided with at least one ram-like portion which extends downwardly beyond the bottom edge of the respective floats in order to support the framework structure by engaging the ocean bottom before the float can come in contact with the same. It is also advantageous in this connection if the floats themselves are of substantially conical or approximately conical configuration, with the tip of the cone facing upwardly.

In this construction, the lower end of the ram-like element engages the ocean bottom and prevents the floats from contact with the same. The substantially conical configuration of the floats provides for the best possible transmission of forces between them and the framework structure, as compared to other configurations. The framework structure is then supported on the ram-like element while the foundation-forming material is supplied onto the ocean bottom from above, and is subsequently united by the injection of liquid concrete. By affording a precisely controllable spacing between the downwardly directed surface of the bottom floor of the respective floats and the ocean bottom itself, this arrangement also offers a well-defined area onto which the foundation-forming material can be poured. Of course, the load is transmitted directly from the ram-like element (of which more than one may be provided) into the framework structure. To obtain as large as possible a contact area between the ram-like element and the ocean bottom, and in order to accommodate this contact area as much as possible to the ocean bottom, it is advantageous if that portion of the ram-like element which extends downwardly below the bottom edges of the floats has mounted on it by means of a ball and socket joint a pad which engages the ocean bottom. The lower end of the ram-like element may extend into or through an opening in the pad which is so dimensioned that the pad has radial play relative to this lower end portion, and above and below the pad the lower end portion may be provided with abutments limiting relative axial movement of the pad with reference to the lower end portion. The ram-like structure is advantageously hollow and formed at its lower end with a portion with an opening to permit foundation-forming material to be poured through the ram-like element onto the area beneath the pad, shortly before the pad comes into engagement with the ocean bottom, so as to in effect form a foundation for the pad. This opening can be made to be closed so that the foundation-forming material to be dispensed to the area beneath the pad can be accommodated in the hollow ram-like element; it will then be opened shortly before the pad comes into engagement with the ocean bottom, permitting the material to drop onto the ocean bottom before the pad comes into engagement therewith.

It is desirable that foundation-forming material be also poured on top of the pad; for this purpose it is advantageous if the ram-like element is provided with a further opening located upwardly of the pad and through which some of the foundation-forming material may pour onto the pad.

The pad need not be connected via a ball and socket joint to the ram-like element; in order to make the arrangement even more resistant in horizontal direction against underwater currents, without requiring any additional structures or work, the pad can also be rigidly connected with the ram-like element and on its side which faces away from the framework structure it may be provided with ribs that are high with respect to the size of the pad and which together with portions of the pad form a honeycomb structure. Such a construction has various advantages. One of these is the fact that the high ribs offer very high resistance to horizontally acting forces, but offer relatively low resistance to penetration into the ocean bottom. The vertically acting forces transmitted to the pad assume high values only after the ribs have completely penetrated the ocean bottom and it is not the actual body of the pad that is in contact with the surface of the ocean bottom. This can be achieved readily since the diameter of the pad and its height, the configuration of the ribs and the load exerted upon the pad by the framework structure can always be so coordinated with reference to one another and with reference to the structure of the ocean bottom, that a full penetration of the ribs into the ocean bottom is guaranteed. In the event that for any reason the resistance of the ocean bottom to penetration of the ribs should be higher than calculated, the specific horizontal displacement resistance of the ocean bottom is correspondingly greater. An improved penetration of the ribs is obtained if apertures are provided in the pad which communicate with the respective cells formed by the honeycomb configuration, so that water can be expelled from those cells as the ribs penetrate into the ocean bottom. For reasons of structural strength, it has been found advantageous if the pad is of conical or somewhat conical configuration with the tip of the cone facing upwardly.

An optimum action of a pad having the honeycomb configuration is obtained with respect to all directions of thrust by a symmetrical configuration of the ribs, in that the ribs are of two types of which one type surrounds the longitudinal axis of the ram-like element, whereas the other type of rib radiates from the first ones. It is also advantageous if those edges of the ribs which face away from the pad are located on an imaginary cone surface. This assures that the surfaces of the ribs which resist lateral thrust are stepped in surface area and therefore assume approximately equal portions of the load when thrusts occur. The ability to withstand load can be further improved if those regions of the ribs located adjacent the aforementioned imaginary cone surface are reinforced at the points of intersections of the ribs by supporting pipes, and are further reinforced at intermediate locations by profiled reinforcing members which extend parallel to the axis of the ram-like element. With such a construction only the load-bearing portions of the ribs are reinforced, that is the free edges which penetrate into the ground and which might—in the absence of reinforcement—bend over.

The structural strength of the floats will be particularly high if the floats are of conical or approximately conical configuration and if their walls are slightly concave; the walls may also be provided with concave ribs for reinforcement purposes.

If the rig according to the present invention is of the type in which the platform is supported by a plurality of the framework structures which diverge from one another in direction downwardly towards the ocean bottom, then it has been found particularly advantageous that in the type of pad having the pipe-reinforced ribs the number of reinforcing pipes below that half of the pad which in a top-plan view of the rig faces away from the bottom end of the rig, are longer and/or are provided in greater numbers than the remaining pipes.

The desired resistance to horizontal displacement can also be obtained by utilizing in lieu of the pads, a pile-shaped element which extends transverse to the vertical direction of the framework structure and is shiftable in this transverse direction, this element having a lower head which can be projected downwardly beyond the framework structure and penetrates into the ocean bottom. Such an element is subjected, when lateral forces act upon the rig, to nothing more than shear forces which are not particularly strong since these forces cannot develop to any great extent due to the high frictional resistance between the framework structure and the ocean bottom. For this reason the pile-shaped elements need be of relatively small cross-sectional area and do not need to penetrate particularly deeply into the ocean bottom, since they are subjected only to relatively weak shear forces. A fraction of the height of the framework structure is a measure for the extent to which the pile-shaped elements should penetrate into the ocean bottom. This is a particularly inexpensive way of achieving the desired effect.

Particularly if the floats are of the type having an upwardly conical bottom wall, thus forming a hollow beneath the wall, it is advantageous if the head of the pile-shaped element is constructed as a flushing device which flushes the ocean bottom by means of ejected pressure fluid. Such a construction makes it possible to produce beneath the floats double plugs of concrete which counteract the thrust and one end of which fills the conical space beneath the upwardly conical bottom wall of the float whereas the other end is embedded in the ocean bottom to a depth of several meters. The hole required to form such a concrete float is formed by the head of the pile-shaped element from which pressure fluid is ejected and which flushes the ocean bottom material out of the way as the head penetrates into the ocean bottom, thus forming the necessary hole in which the concrete plug can subsequently be produced. To prevent the just flushed away sediment from immediately closing up the newly formed hole again, it is advantageous if the head is fomed with nozzle-like openings which so eject streams of the pressure fluid that the streams will travel in a direction in which they include with the axis of the hole being formed an angle other than 90°. The heads may be made turnable about upright axes to facilitate the flushing operation.

According to a further concept of the invention, it is also advantageous to use a drilling rod with a drilling head as the pile-like element, and to provide an arrangement for rotating the drilling rod; a pressure flushing arrangement for the drilling head may be provided. The drilling rod could also be replaced by a pile having a ram associated with it. The latter two possibilities appear at first sight to be more economical to use than the first-mentioned possibility in which the hole must be hydraulically prepared and a concrete retaining plug formed therein. However, the flushing arrangement for preparing the hole actually requires little additional expense, since the main flushing arrangements—the earlier-mentioned spider-like structures—are in any case present. It should also be understood that it might be possible to use the formation of the concrete plug in conjunction with the use of a pile that is rammed into the ocean bottom or in conjunction with a drilling rod. The use of a drilling rod or of a pile driven by a ram is particularly advantageous if the earlier-mentioned supporting element is used which supports the floats initially out of contact with the ocean bottom, and if this element is made hollow so that the pile or drilling rod can be extended through it. The pile or drilling rod may themselves be hollow and provided at their respective lower end with an opening which is closed by a portion of the spacing element when the pile or drilling rod is retracted into the latter. The pile or drilling rod may then accommodate a quantity of foundation-forming material in their respective hollow interior, which is poured out through the hole when the latter is opened as the pile or drilling rod are extended downwardly of the spacing element. This can also be used in conjunction with a ground-engaging pad in which case the thus dispensed foundation-forming material will provide a support for engagement by the pad before the thrust-resisting measures are initiated.

It has earlier been mentioned that devices are provided for maintaining a uniform floating and swimming position of the rig in the water, before and during the lowering of the rig into contact with the ocean bottom. If the rig is of the type which is floated to the installation site in an upright position, which is then simply lowered to the bottom in upright position, these arrangements may be of a recoverable type and may be so arranged as to exert a desired force upon the rig; the magnitude and direction of this force may be automatically calculated and adjusted by means of a computer in accordance with impulses derived from a sensing system that senses the orientation of the rig in the water. The arrangements may include a plurality of horizontal-thrust jet engines which are mounted on the platform symmetrically about the vertical axis of the rig and which are pivotable.

The use of such arrangements permits a simple but effective stabilizing of the rig in the pre-foundation phase of the rig installation, which ends when the foundation-forming material has been poured into the spaces beneath the floats. These orientation-maintaining or stabilizing elements are easy to operate and easy to install and remove. They are of relatively little weight so that they cannot only be readily recovered but also reused. The mounting of these stabilizing elements, including the computer together with the orientation sensing system, can be effected in a simple manner so that they can be readily removed and reused. Due to their low weight, the jet engines with their associated components can be mounted at the highest location of the drill rig, that is on the platform, so that due to the long lever arm thus obtained they need not be particularly strong as to thrust. Moreover, once the rig is firmly in place the jet engines will still be above water and then can be readily removed. It is, incidentally, advantageous to use reversible thrust jet engines so that the necessary thrust direction can be readily reversed if this becomes necessary.

The effectiveness of this arrangement is further improved if the lower region of the rig has associated with it further recoverable arrangements which exert upon the rig a force whose magnitude can be varied and which are also associated with and controlled by the computer, exerting a torque about the center of gravity of the rig which always corresponds in its sense with the torque exerted by the upper arrangements, e.g., the aforementioned jet engines.

The arrangements that are provided in the lower region of the rig, on the other hand, are advantageously a plurality of drive units having ship propellers whose axes of rotation are either vertical or are horizontally pivotable, these propellers may also be provided with adjustable propeller blades. These drive units are mounted symmetrically about the vertical axes of the rig and have the same purpose as the jet engine on the platform. They are controlled centrally and simultaneously by the computer to which they are connected, as are the jet engines. These small drive units are quite compact and known in the prior art; they can be mounted on the lower region of the rig in such a manner that they can be released by remote control and can then be recovered from above, for example by hauling them up via ropes or cables that were previously connected to them with the purpose of ultimate recovery in mind.

A stabilizing effect can also be obtained if at least two diametrically opposite ones of the floats are provided with arrangements permitting the water in one of the floats to be expelled to a greater or lesser degree, and permitting the other float to be flooded to a greater degree than would normally be the case. This changes the flotation effect so that at one side the flotation effect is greater and on the other side it is lesser, whereby possible tilting of the rig which is in process of being lowered to the ocean bottom, can be counteracted.

In such an arrangement, the two (or more) floats which are used for orientation-maintaining purposes may be provided with gas generators and with openings which can be opened and closed and via which the interior of the respective float can be communicated with the atmosphere above the upper water level. The gas generators are known in the art and will rapidly generate sufficient gas to cause a pressure increase in the respective float, so as to expel a quantity of water from the same--which quantity can be determined by the computer--and cause a rapid change in the buoyance of the float.

Another stabilizing measure envisions the use of sets of lines which are connected to the platform symmetrically spaced about the vertical axes of the rig. Each set of lines is subdivided into two groups of lines each composed of one or more individual lines. Each of these groups can be individually paid out or taken up, and their free ends are intended to be anchored at locations which are remote from the rig, that is on locations that are outwardly spaced from the rig. Advantageously, each of the sets of lines has two groups, and the lines of one group extend directly to their anchoring points whereas the lines of the other group are first trained around a roller mounted in the bottom region of the rig and then extend to their anchoring point. It is advantageous if each set of lines has a mooring winch associated with it, which may be mounted on the platform, and if each mooring winch has a number of takeup and pay out drums corresponding to the number of groups of lines per set.

Such an arrangement can be utilized to the same effect as the jet engines and the lower marine propulsion units. It is clearly cheaper than that other possibility, and has the particular advantage that it is not necessary to recover any arrangements from beneath the water since the stabilizing forces acting upon the lower region of the rig are the result of the special manner in which some of the lines are guided about the aforementioned rollers.

Still a further possibility that can be used in lieu of the jet engine and marine propulsion units is to provide auxiliary flotation devices which are arranged about the rig and which can shift in vertical direction relative to the same. These devices will be pressed against the rig in any relative orientation thereto, and tensioning means are provided for this purpose which automatically effect such contact and which extend circumferentially of the rig to connect these flotation units together. The individual flotation units are also connected by means of lines with a lower region of the rig, and abutments along the vertical extension of the rig may predetermine the position of at least one of the auxiliary flotation units transversely to the vertical extension of the rig. Such as arrangement has various advantages, including the fact that the designer is free to select the dimensions and tolerances of the auxiliary flotation units, because the latter are located outwardly adjacent the rig and are therefore not subject to space limitations. Since they are in constant contact with the rig, there is no banging of any of the units against the rig to be expected. If only one of the units of fixed in transverse direction of the rig by the aforementioned abutments, the entire system of auxiliary flotation units will be firmly maintained in place. The adjustable devices for drawing the flotation units against and into contact with the rig accommodate themselves to the contour of the rig and therefore prevent banging of the flotation units against the rig even if the rig is of the type having differential outer dimensions, for example if the rig converges in upward direction. The flotation units are advantageously each provided with a spacing element having a free end provided with an engaging portion which engages in one of a plurality of guide rails extending vertically on the rig; this prevents a pushing of the flotation units out of contact with the rig by the waves, which would otherwise occur despite the fact that they are being drawn towards the rig by the connecting arrangement provided for this purpose. The facing ends of adjacent ones of the auxiliary flotation units are advantageously connected with one another by means of ropes or cables, and these may be connected to at least one mooring winch which assures a constant tension upon the flotation units independently of whether or not the outer dimension of the rig varies (e.g., converges in upward direction) or whether there is a tendency by the waves to lift the flotation units out of contact with the rig. The connection of the individual flotation units with the lower region of the rig is advantageously effected via ropes or cables which are mounted on the respective flotation unit, or rather which are connected to a mooring winch mounted on the flotation unit. Here the mooring winch is assured that vertical movements of the flotation units during the lowering of the rig onto the ocean bottom are not transmitted to the rig, since they take up and pay out the rope or cable to compensate for such vertical movements, e.g., bobbing of the flotation unit. The guide rails used extend advantageously in the immediate vicinity of the framework structure of the rig, and also via a transitional portion in the immediate vicinity of the floats, so that the flotation units will always be close to the rig irrespective of the level relative to the rig at which they are located. They should, of course, come as close to the rig as is possible. If the rig is of a type having four corners, then three of the corners may each be provided with one of these guide rails; the fourth corner is provided with two guide rails which are arranged symmetrically with reference to the fourth corner and the abutments are similarly arranged symmetrically with reference to the fourth corner. All of the mooring winches can be centrally controlled from the platform of the rig in dependence upon the rate at which the rig is allowed to descend through the water towards the ocean bottom.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side view illustrating a first embodiment of a rig according to the present invention, in the orientation in which it is towed to the installation site and the lowered to the ocean bottom;

FIG. 2 is a fragmentary somewhat diagrammatic section on line II—II of FIG. 1;

FIG. 3 is an enlarged-scale vertical sectional detail view illustrating the lower end region of one of the legs in the embodiment of FIG. 1, before the float associated with the leg is lowered into engagement with the ocean bottom;

FIG. 4 is a section taken on line IV—IV of FIG. 3;

FIG. 5 is an enlarged-scale fragmentary sectional detail of FIG. 4;

FIG. 6 is a section taken on line VI—VI of FIG. 7;

FIG. 7 is a section on line VII—VII of FIG. 6;

FIG. 9 is a simplified view analogous to FIG. 8, illustrating still a further embodiment of the invention;

FIG. 10 is a side view of a further embodiment of a rig according to the present invention;

FIG. 11 is a somewhat diagrammatic section taken on line XI—XI of FIG. 10;

FIG. 12 is a somewhat diagrammatic section taken on line XII—XII of FIG. 10;

FIG. 18 is an enlarged-scale section taken on line XVIII—XVIII of FIG. 16;

FIG. 19 is a view similar to FIG. 15, but illustrating a further embodiment of the invention with parts broken away for clarity of illustration;

FIG. 20 is a top-plan view of FIG. 19;

FIG. 21 is an enlarged-scale detail view partly in section showing a detail of the embodiment in FIGS. 19 and 20;

FIG. 25 is a diagrammatic vertical section illustrating a further embodiment of the invention;

FIG. 26 is a side view illustrating a detail of an additional embodiment of the invention;

FIG. 27 is a section on line XXVII—XXVII of FIG. 26;

FIG. 28 is a vertically sectioned detail view illustrating a detail of FIG. 26;

FIG. 29 illustrates a modification of the embodiment in FIG. 28;

FIG. 30 is a diagrammatic side view of a further rig according to the present invention;

FIG. 31 is a top-plan view of FIG. 30;

FIG. 32 is a diagrammatic vertical section of another embodiment of the invention;

DESCRIPTION OF THE PREFERRED EMBODIMENTS

Figure 8:
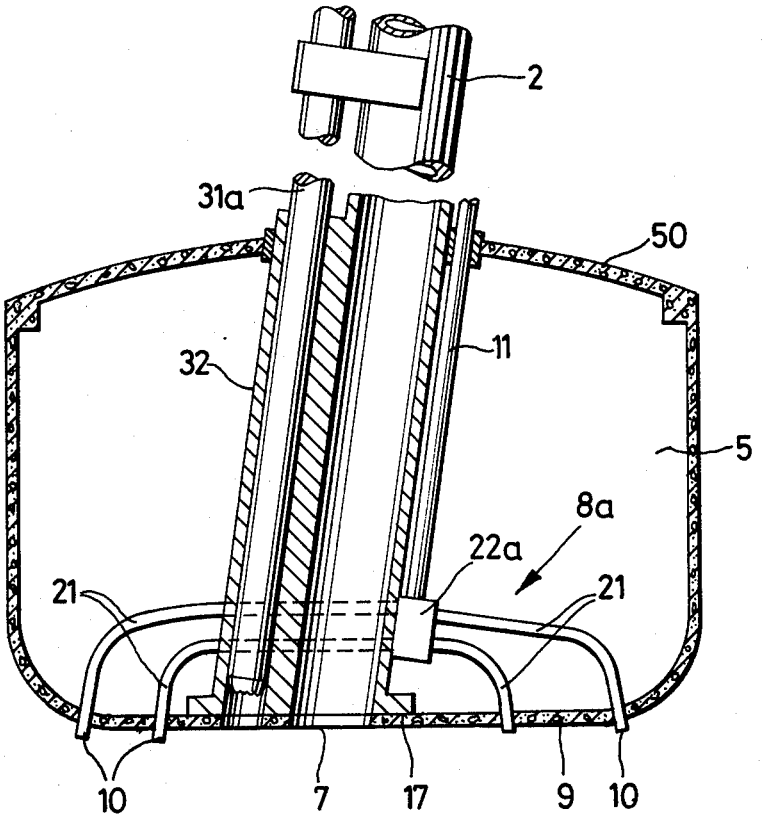
FIG. 8 is a view analogous to FIG. 3 but illustrating a different embodiment of the invention.

The embodiment of the offshore drilling rig of the present invention as illustrated in FIG. 1 is of a rigid rig, that is a rig having a single rigid framework structure with a working platform 3 and downwardly depending legs 2. Such a rig is constructed in upright position on land, and is towed to the site at which it is to be lowered into the ocean in this same upright position, whereupon it is lowered into the ocean and onto the ocean bottom while still being in this same upright position. In a top-plan view, the framework structure 1 is of rectangular outline; it has eight uniformly spaced tubular legs 2 and a plurality of cross braces 13 and 13*a;* the latter cross braces are horizontally oriented; all or some of the cross braces may be hollow. The lower ends of the legs 2 are supported by floats 5 which are ballas able, that is which can be flooded or whose interior can otherwise be ballasted. Each of the floats 5 has mounted on it a deformable skirt 6 which can be maintained in an upper raised position during the transportation of the rig, and which can then be released to depend downwardly below the lower edge of the associated float 5, as illustrated with respect to the center one of the three floats 5 illustrated in FIG. 1. The purpose of the skirt 6, which is mounted on its float 5 by means of a mounting arrangement 28 so as to surround the float, is to engage the ocean bottom and to confine foundation-forming material (e.g., rocks, gravel and the like) that has been poured into the space beneath the float 5, from escaping outwardly. The purpose of placing the foundation-forming material in this position is to assure a proper support for the float 5, so that the latter will be uniformly supported everywhere on the ocean bottom. The outline of the rig 1 is shown in a fragmentary top-plan view in FIG. 2.

FIG. 3 shows in detail how respective ones of the cross braces 13, 13*a* are connected with the interior of a rig 2 within the float 5 associated with the lower end thereof. The float 5 has a cover 50 which closes it in an air-tight sense and a circumferential wall, and the cross braces 13 and 13*a* extend in sealing relationship through the cover 50 and the circumferential wall, respectively.

Of course, the cover and the wall can also be of one piece with one another, or the cross braces could be connected with the rig outside the float 5, or they could be secured to the outside of the float 5 itself, for example by means of flanges.

The floats are advantageously of reinforced concrete and have a conically upwardly converging bottom wall 9 which is provided at its highest point with an opening 7 in the region of which there is a rigid water-tight connection 17 with the open end of the associated leg 2, via a large-dimensioned flange 57 which engages the bottom wall 9 from beneath. The opening 7 is initially closed by a plate 55 which can be dropped later on, so that no water can enter the float 5 and the leg 2. In this condition, the hollow interior of each leg and each float aids in providing buoyancy for the rig, during transportation and during subsequent lowering of the rig onto the ocean bottom. In fact, this buoyancy may be further increased if any or all of the cross braces 13, 13*a* are hollow and tubular as is illustrated in FIG. 3 and are so connected with the legs 2 that there is a junction 14 (which, incidentally, also exists at all other points where the cross braces meet and intersect).

A flooding conduit 53 extends from the region of the lowest point of the float 5 and is sealingly extended through the cover 50 and in upward direction approximately to the platform 3. At a plurality of longitudinally spaced locations (see FIG. 1) the flooding conduit 53 is provided with connections 54 which are normally closed. When the rig is being lowered to the ocean bottom, a source of ballasting water—for example a water pump of a supply ship—is connected with that one of the connections 54 which is closest to the surface of the ocean. When the rig has descended to the point where this connection is about to become submerged, the source of ballasting water is disconnected from the connection, the latter is sealed, and the source is reconnected to the next-higher connection 54. The inflow of the ballasting water into the float 5 is regulated—if desired, in automatic manner—in dependence upon the rate at which the rig descends in the ocean.

The reason for having the outlet end of the ballasting conduit 53 located at or near the lowest point of the float 5 is to prevent escape of air through the conduit 53. As soon as the incoming water has risen above the outlet end of the conduit 53, it provides a seal and prevents the escape of air. The air in question is compressed air which is admitted into the float 5 in order to provide above the level of water therein a counterpressure to the pressure of the ocean which increasingly acts upon the float 5 as the rig descends farther and farther, and tends to collapse the float. The admission of this compressed air is effected via a conduit 12 which also serves for venting of the float 5 and extends upwardly—e.g., to the platform 3—from or near the highest point of the cover 50. At or near the platform 3, the conduit 12 is provided with a valve 33. In order to assure that the venting and pressurizing of the floats 5 can be effected via a single conduit 12, all of the floats 5 of the rig are connected by means of conduits (not shown) which may be mounted on the cross braces or otherwise secured.

If the floats are so dimensioned that their flooding or ballasting with water alone will serve to cause the rig to descend in the ocean to the bottom, then the use of floating cranes and similar aids is not required, or required only to a minor extent. In this case, the floats 5 are gradually flooded—possibly with interspersed pauses for control purposes—until the rig engages the ocean bottom. Thereupon the legs 2 and the cross braces 13 and 13*a* are also flooded. For this purpose, one or more of the legs 2 are provided with holes 56 that can be closed by a closure device 67, the holes 56 being so arranged that they will be beneath the water level when the rig is supported on the ocean bottom. After the rig is placed on the ocean bottom, and the legs 2 and cross braces 13 and 13*a* have been filled with water, the pressure upon the plates 55 from inside and from outside becomes equalized and the plates 55 can then drop away, exposing the openings 7 for reasons to be discussed subsequently.

The circumferential wall of each leg 2 is provided downwardly below the cover 50 of the respective float 5 with large openings 4 which are sealingly closed by a closure arrangement 15 which is located within the leg 2 and is supported on ropes or cables 16 that extend up to the platform 3, so that by manipulating the ropes or cables 16 the closure arrangement 15 can be raised and lowered with reference to the openings 4. FIG. 4 shows that the arrangement 15 utilizes a tubular member 60 which has opposite open ends and which is received with clearance in the leg 2. Located in this clearance are elastically yieldable seals 58 and 59. The seals 59 are located adjacent and accommodated to the edges of the openings 4, whereas the seal 58 is also located adjacent the edge of one of the openings 4 but is of the inflatable type which can be inflated from a remote-controlled arrangement (not shown) via a bore 69 of the tubular member 60. When it is so inflated, it presses against the inner side of the leg 2 and the outer side of the tubular member 60, providing a seal. At the same time, it presses the tubular member 60 into contact with the noninflatable seals 59, so that the three openings 4 are sealed.

Located at the exterior of the respective float 5, and more particularly in the illustrated embodiment beneath the bottom wall 9 thereof, is a spider-like structure 8 which is composed of a plurality of tubular members having outlets 10 that face upwardly, outlets 10*a* that face downwardly and outlets 10*b* that face radially. These tubular members are identified with reference numeral 23 and are mounted on a base plate 51; they radiate from a central distributor 22 which is also mounted on the base plate 51. Each spider-like structure 8 is turnable and can also be shifted lengthwise of the axis of the respective leg 2, that is can be raised and lowered. For this purpose, a separate conduit is provided which is connected with the distributor 22 by means of a ball joint 61 that yields only when it is subjected to a force but does not change orientation in the absence of a force; the conduit 11 extends upwardly through the leg 2 to the platform 3; within the leg 2 it is supported in sliding relationship and against bending or twisting by means of thin support brackets or ribs (not illustrated). Inclined guide baffles 52 are provided on the base plate 51 adjacent the outlets 10*a*, so that pressurized medium that is pumped at high pressure into the tubular members 23 and issues in form of high pressure jets from the outlets, including the outlets 10*a*, will be guided in a desired direction. The medium is admitted under pressure into the conduit 11 at the platform 3.

It is desirable that the medium be discharged only in downward direction and in radial direction, if this medium is water that is used to flush away silt and mud on the ocean bottom. For this purpose, the tubular members 23 may be subdivided into two groups 24 and 25, as illustrated in FIGS. 6 and 7. The central distributor 22 accommodates a further distributor 27 which is connected with an additional conduit 26 that extends with clearance through the conduit 11 and also to the platform 3. The tubular members 23 of the group 24 extend through the central distributor 22 and are connected only with the inner distributor 27, whereas the tubular members 23 of the group 25 which have the upwardly directed outlets 10 are connected only with the central distributor 22. If this construction is chosen, then the ball and socket joint must be somewhat different from the one previously described; it is identified with reference numeral 61*a* in FIG. 7 and, of course, must make provision for the fact that there are two coaxial conduits 11 and 26. Its construction is clearly shown in FIG. 7. The purpose of providing a separate conduit for each of the two groups 24 and 25 is to supply the tubular members 23 of the group 24 having the downwardly and radially directed outlet openings with water, so as to flush away silt and mud from the ocean bottom. The tubular members 23 of the group 25, however, having the outwardly directed openings 10, are supplied with liquid concrete which is injected in form of upwardly directed jets from the outlet openings 10, for reasons to be discussed.

Once the rig has been lowered to the point where the respective floats 5 assume substantially the position shown in FIG. 3, the further descent of the rig is stopped. The skirts 6 which have meanwhile been deployed, extend downwardly of their associated floats 5 and engage the ocean bottom, as shown in FIG. 3, accommodating themselves to the possibly varying contour of the bottom. Now the spider-like structure 8 associated with the float 5 that is closer to the ocean bottom is moved downwardly towards the ocean bottom and may also be rotated, while water under high pressure is ejected from its outlets 10*a* and 10*b*, to thereby flush the ocean bottom beneath the float 5 of silt and mud. If the construction is in accordance with the one shown in FIGS. 6 and 7, then water is admitted under high pressure via the conduit 26. The now flushed-up or stirred-up silt or mud is either pushed out beneath the lower end of the skirt 6, or if the skirt happens to be of the type that is permeable to such material, for example if it is of a net-like material, the silt and mud will travel directly through the apertures of the skirt. If the water pressure is sufficiently high, then the flushing away of the silt and mud may be followed by the formation of depressions in the ocean bottom, for which purpose the rotary motion of the spider-like structure 8 will be stopped. Alternately, using high pressure water jets and continuing the rotation of the spider-like structure 8, annular or part-annular grooves may be formed in the ocean bottom which are important in terms of the subsequently following formation of the foundation.

When the flushing of the ocean bottom—and possibly the formation of depressions or grooves therein—is completed, the spider-like structure 8 is lowered still further until the plate 51 is in contact with the ocean bottom; due to the joint 61 or 61*a* it can accommodate itself to the contour of the bottom. Thereafter, crushed rock, gravel or the like is poured or flushed from the platform 3 through the respective leg 2 until it fills up the space beneath the bottom wall of the associated float 5, that is the space which is surrounded by the respective skirt 6. This filling is facilitated by the fact that in this particular embodiment the bottom wall 9 is of upwardly convex configuration. When the space is completely filled with the foundation-forming material, either immediately after the filling is completed or after the elapse of some time during which weight has rested upon the material—liquid concrete is pumped from the platform under high pressure through the conduit 11 to issue from the upwardly directed outlet openings 10 in form of strong jets. These jets penetrate the heap of rocks or other foundation-forming material and set, uniting all of this material into a solid block. Of course, special underwater concrete will be utilized for this purpose, as is known in the art. The concrete will, incidentally, also penetrate into any depressions or grooves that were formed in the ocean bottom by operation of the spider-like structure, and the concrete that hardens therein will be unitary with the block of concreted-together foundation-forming material, so that the resistance of the rig against thrust and tensile forces is substantially increased. It is advantageous to provide the downwardly directed surface of the bottom wall 9 with spikes 19, ropes or cables 66 and other anchoring portions 20, which project downwardly and which become embedded in the unitary block formed of the foundation-forming material and the injected liquid concrete. Of course it will be appreciated that if the construction is not the one shown in FIGS. 6 and 7, but instead the spider-like structure is the one shown in FIG. 3, liquid concrete will be ejected not only in upward direction but in all directions in which water is previously ejected, so that the downwardly directed jets of liquid concrete may even penetrate into the ocean bottom.

When the site preparation or foundation formation has been completed with respect to the float 5 that is closest to the ocean bottom, the above steps are preceded with respect to the other floats, except that for the time being new liquid concrete is injected into their foundation-forming material. The rig will float during this time in an almost completely balanced position; it can be raised slightly by means of the quite strong conduits 11 (which, of course, are pipes) associated with the respective floats 5, in order to permit foundation-forming rocks or the like to slide out of the respective legs and completely fill the spaces beneath the floats 5. When the operators are convinced that the spaces are completely filled, the liquid concrete is then also injected into the foundation-forming material beneath the other floats 5. As this takes place, the openings 4 are exposed by terminating the inflation of the seal 58 and either raising or lowering the member 60 with reference to the openings 4 and by means of the ropes 16. Thereupon gravel or broken stone is poured into the upper ends of the legs 2 and issues via the openings 4 (compare the arrows in FIG. 3) into the float 5, filling the same and ultimately rising within the respective leg 2 to the level of the platform 3. This completes the establishment of the rig on the ocean bottom.

The purposes of the floats 5 as explained before can now be summarized by stating that they serve to support the rig in upright position floating on the water until it reaches the installation site, that they thereafter serve to permit its controlled descent to the ocean bottom in upright position, and that finally they serve to provide a foundation and to anchor the rig on the ocean bottom and to increase the available foundation-forming area (note the size of the area surrounded by the skirt 6 in FIG. 3).

Coming to the embodiment in FIG. 8, it is pointed out that this can be used with the embodiment of the preceding Figures. It differs from this embodiment in having a different spider-like structure 8*a*. All other details may be identical or analogous to those of the preceding embodiment and have therefore not been shown.

The spider-like structure 8*a* in FIG. 8 is located within the float 5 and is composed of a plurality of pipes 21 which radiate in a spider-like or star-like fashion from a distributor 22*a* that is mounted on the leg 2 and from which the supply conduit 11 extends upwardly as in the preceding embodiment. The free ends of the pipes 21 have the outlet openings 10 and extend in sealing relationship through apertures provided for this purpose in the bottom wall 9. It will be appreciated that in this embodiment the spider-like structure 8*a* cannot be used to flush silt and mud away from beneath the float 5, since it can be neither rotated nor raised and lowered. However, in this embodiment, that function is performed by a spray head or flushing head (not shown) that can be lowered through the respective leg 2 and can perform the same function as the spider-like structure 8 in the preceding embodiment whereupon it is withdrawn upwardly and recovered. In this embodiment, also, the gravel or rock that has been admitted through the leg 2 can be compacted by lowering a compactor—e.g., a vibratory compactor—through the leg 2, whereupon liquid concrete jets are ejected from the openings 10 of the spider-like structure 8*a* in downward direction.

The embodiment in FIG. 9 is intended particularly for applications where relatively significant variations exist in the level of the ocean bottom. For this purpose, the leg 2*a* is composed of a long outer pipe 18 and a shorter inner pipe 29 which is telescoped into the lower end of the leg 2*a* with a significant radial play *a*. The inner pipe 29 has its lower open end rigidly connected with the bottom wall 9 of the float 5 and is provided with the previously discussed openings 4 which can be closed in the same manner as also described with respect to FIG. 3. The float 5 surrounds the portion of the inner pipe 29 that is provided with the openings 4. Ropes or cables 62 are secured to the inner pipe 29, in the illustrated embodiment to the upper end thereof, and extend to the platform 3 where they are also secured, so that the float 5 is drawn against the lower end of the outer pipe 18 (it is shown in separated condition in FIG. 9 for the sake of clarity). Arranged at the lower end of the outer pipe 18 is provided a seal 68 which permits controlled axial sliding or telescoping of the inner pipe 29 relative to the outer pipe 18. In this embodiment, the cross braces 13 and 13*a* (only a cross brace 13*a* is shown) engage the outer tube 18 upwardly of the float 5.

To prepare for the formation of a foundation, the inner tube 29 together with the float 5 are allowed to descend to the desired height above the ocean bottom (after the rig has first been lowered to the desired depth). Foundation-forming material is then poured onto the ocean bottom beneath the bottom wall 9 as in the preceding embodiments, and further material is then admitted into the float 5 by exposing the openings 4. After this is completed, liquid concrete is admitted through the outer tube 18 into the clearance a between the tubes 18 and 29 to fill this clearance and concrete the inner tube 29 in place so that it can no longer shift relative to the outer tube 18. Thereupon, the outer tube 18 can be filled with rock or gravel up to the platform 3, in the manner described previously.

FIG. 10 shows a further way in which compensation can be made for variations in the level of the ocean bottom. Here, the legs 2 themselves are so mounted that they can be shifted upwardly and downwardly. This embodiment makes it possible to compensate for variations in the level of the ocean bottom not only at the time the rig is installed, but also later after the rig is installed, should there be any changes in the ocean bottom due to settling or the like. The legs 2 in the embodiment of FIG. 10 are not rigidly connected with the cross braces 13 and 13*a;* instead, the framework structure has upright structural members which are rigidly connected with the cross braces 13 and 13*a* (which, or course, do not extend into the floats 5 in this case) to form an independent rigid framework structure 1*a*. The legs 2 are mounted slidably on these upright structural members by means of sleeves 63 which receive the legs 2 with slight play and which are mounted at the junctures of the horizontal cross braces 13*a* on mounting 64 (see FIG. 11). Intermediate to successive sleeves 63 each of the upright structural members 20 is repeatly supported by means of a clamp or bracket 65 which loosely surrounds the leg 2 (see FIG. 12) so that the possibility of buckling of the upright structural members 30 is very slight.

In the event that after the rig is anchored on the ocean bottom, the platform 3 should not have a precisely horizontal orientation, then its orientation with reference to the framework structure 1 or 1*a* may be varied, for example by hydraulic means.

Figure 13:
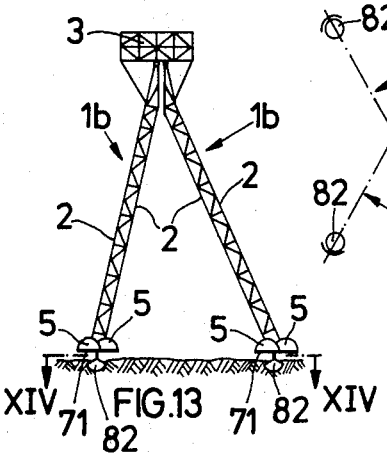
FIG. 13 is a simplified side view illustrating a rig according to a further embodiment of the invention.
Figure 14:
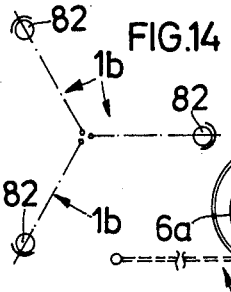
FIG. 14 is a section on line XIV—XIV of FIG. 13.

Some or all of the measures described with respect to the preceding embodiments that are concerned with rigid rig structures, can also be utilized with the type of rig having a plurality of framework structures which themselves constitute the legs 2 and which can be pivoted relative to the platform 3 to a horizontal position so that the rig can be floated to the installation site on the water in horizontal rather than upright orientation. FIGS. 13 and 14 show such an embodiment wherein the framework structures are identified with reference numeral 1*b* and constitute the legs 2. These framework structures 1*b* are, of course, substantially narrower than the massive framework structure 1 of FIG. 1.

Each of the framework structures 1*b* has at its corners 3 pipes constituting respective legs 2. The lower end of each pipe is anchored in one of the floats 5 which are here of upwardly conical configuration. The three floats 5 associated with each of the framework structures 1*b* are grouped together as shown in FIGS. 14, 15 and 16.

It should be understood that although the particular characteristics and advantages of the embodiment in FIGS. 13 and 14 will hereafter be described and are directed to a rig wherein the structures 1*b* can be pivoted relative to the platform 3, this does not preclude that any or all of these features might also be used to advantage with the rigid type of rig, for example that shown in FIG. 1.

Figure 15:
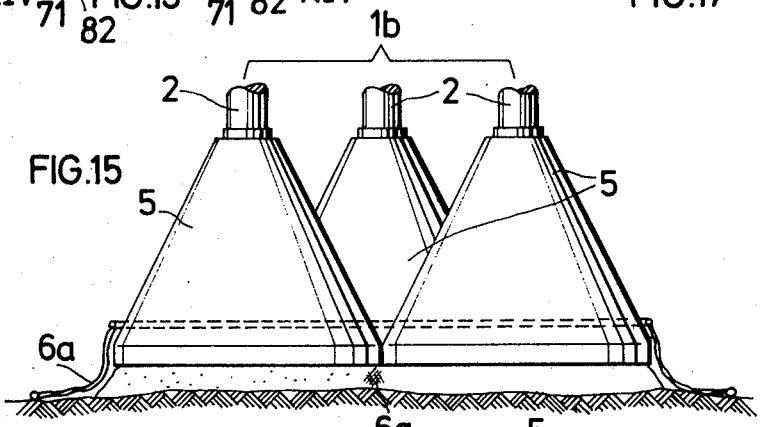
FIG. 15 is a side view of the floats of an embodiment after they have been installed on the ocean bottom.
Figure 16:
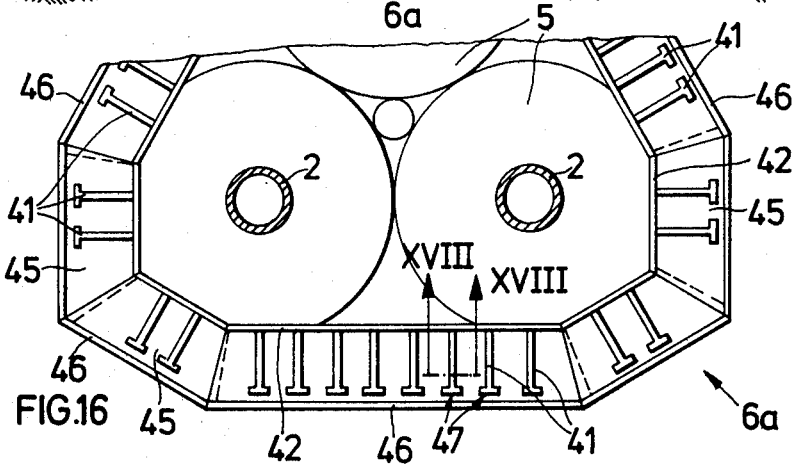
FIG. 16 is a top-plan view of FIG. 15 in a fragmentary illustration.

FIGS. 15 and 16 show that each group of three floats 5 (associated with a respective framework structure 1*b* ) is provided with a common skirt 6*a* that surrounds all three floats 5. Mounted on the surface of the skirt 6*a* are expansible elements, for example in form of hoses 41 (FIG. 18) which are secured to the skirt 6*a* by means of elastic mounting brackets 40. The hoses or other elements 41 are connected with an annular conduit 42 that surrounds the set of three floats 5 and into which compressed air is admitted at one or more locations, so that the hoses 41 communicating with the conduit 42 tend to stretch and to shape the skirt 6*a* in form of a brim 43.

During the transportation of the rig to the installation site, and during the descent of the rig towards the ocean bottom, the skirt 6a is rolled up and secured in this manner by means of releasable ropes 44 or the like on the set of three floats 5. Because of its large dimension, it is advantageous to subdivide the skirt 6a into a plurality of segments 45 the adjacent ends of which overlap and which are connected with one another. These segments can be more readily handled and also will more readily shape themselves to the desired brim configuration when the hoses 41 have compressed air admitted into them.

Figure 17:
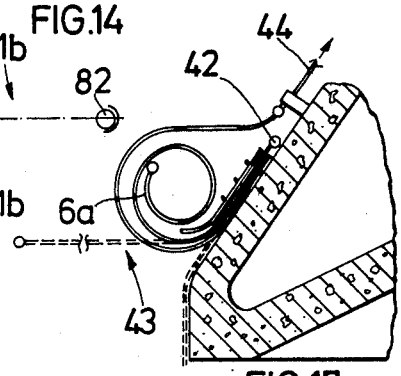
FIG. 17 is a fragmentary vertical section on an enlarged scale showing a detail of FIG. 15.

When the rig is supported on the ocean bottom, for example on spacing members which project downwardly beyond the lower sides of the floats 5 and are not illustrated (but will be described later), and silt or mud has been flushed away from the ocean bottom, the rolled-up skirt 6a is released from the surface (compare FIG. 17) and compressed air is admitted into the hoses 41. This results in the skirt 6a assuming the floating position which is shown in broken lines and in which the hoses 41 provide sufficient buoyancy for the brim 43 to float as shown. The hoses have a tendency to straighten themselves out when compressed air is admitted into them and the brim 43 therefore will extend above the ocean floor for several meters in horizontal direction. Thereafter the supply of compressed air to the hoses 41 is terminated and the brim will then settle in flat or almost flat condition onto the ocean floor, whereupon the formation of the foundation can proceed in the manner described with reference to the preceding embodiments.

The width of the brim 43 in direction outwardly away from the floats 5 is selected in dependence upon the known characteristics of the ocean bottom on which the rig is to be established. In any case, however, the brim 43 must extend on the ocean bottom far enough away from the foundation being formed beneath the floats 5, so that it protects the foundation against the increased underwater current that is a result of the presence of the foundation and of the floats 5. As a general rule, it is sufficient if the brim 43, once it has settled on the ocean bottom, has a width which corresponds to about one-third of the base diameter of one of the floats 5. The base diameter is the largest bottom diameter of the respective float 5. If necessary, the brim 43 can, of course, be made even wider and/or its free edge may be provided with weights 46 to prevent the current from raising the free edge. In this case, the ends 47 of the hoses 41 may be of T-shaped configuration in the vicinity of the weights 46, so that when in floating condition the edge of the brim 43 will not flop over in downward direction.

As the drawing shows, in this embodiment the skirt 6a is composed of a plurality of segments; this has already been explained before. These segments are composed of a high strength synthetic plastic sheet material which must, of course, be resistant to attack by salt water. The sheet material is reinforced by a reinforcing embedment 48, for example in form of wire mesh or the like, advantageously of rust-free steel.

It will be appreciated that in place of compressed air it is possible to expand the hoses 41 by admitting water or another substance into them; of course, there will then be no buoyancy and the "brim" will simply straighten itself out on the ocean bottom rather than floating for the duration of admission of the pressure fluid.

An elongated pile-like or bar-like spacing element 70 is provided on the respective framework structure 1b; its purpose is to prevent undesired contact of the floats 5 with the ocean bottom. To achieve this purpose, the lower end of the spacing element 70 projects downwardly beyond the lower edge 71 of the floats so that as the rig approaches the ocean bottom, it will be the lower end of the spacing element 70 which first comes into contact with the ocean bottom. Since the spacing element 70 is structurally connected with the framework structure 1b, forces are directly transmitted from it into the framework structure 1b and not to the floats 5.

The portion 72 of the spacing element 70 which projects downwardly beyond the float 5 is connected via a ball-and-socket-like junction 73 with a large area ground-contact pad 74; the reason for making the pad 74 in such a manner that there will be a large contact area between it and the ocean bottom is, of course, to reduce the contact pressure, that is the pressure per unit area. Due to the ball and socket structure of the junction 73, the pad 74 can accommodate its position to the contour of the ocean bottom which it engages, and this is further facilitated by the fact that the pad 74 is provided with an opening through which the end portion 72 extends with radial play, being secured to the pad 74 by means of flanges 75 which are respectively located above and below the pad to restrain the latter in axial direction of the element 70.

Reference numeral 76a in FIG. 21 identifies a foundation that has been produced by depositing foundation-forming material such as crushed rock, pebbles or the like, on the illustrated ocean bottom. In order to make this possible, so that pad 74 can rest on such a foundation, the spacing element 70 is hollow and has a lower opening 77 which is provided with a non-illustrated cover. The interior of the element 70 can be filled with foundation-forming material up to the lower end of the openings 78 which are formed in the wall of the element 70. An appropriate arrangement is provided (not shown, but known in the art) by means of which the cover for the opening 77 can be jettisoned shortly before the pad 74 moves into engagement with the ocean bottom; this then allows the foundation-forming material to drop out of the element 70 and to form a heap on the ocean bottom which is subsequently engaged by the pad 74. The element 70, or rather its interior, may communicate in a suitable manner with the region of the platform 3, which then permits additional foundation-forming material to be poured into the element 70 from above so that, after it has risen in the element 70 to the level of the openings 78, it will issue from these openings and become deposited as a foundation in the center region between the several floats 5 of the respective group, as suggested diagrammatically in FIG. 19.

FIGS. 19 and 20 also show that the essentially conical wall of each of the floats 5 is identified with reference numeral 79 and is somewhat convex in configuration, thereby improving the structural strength of the respective float 5, especially against damage resulting from forces transmitted to the float when the weight of the rig finally comes to bear upon it, and also to make the floats 5 as resistant as possible to other mechanical damage. The strength can be further improved by forming the walls 79 with convex reinforcing ribs 80 which need not have an upright orientation, as illustrated, but could also have a transverse or circumferential direction.

Figure 23:
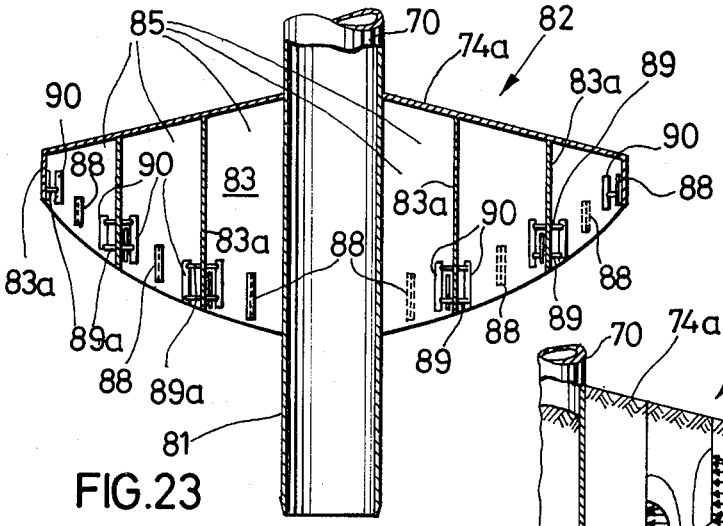
FIG. 23 is a section on line XXIII—XXIII of FIG. 22.
Figure 22:
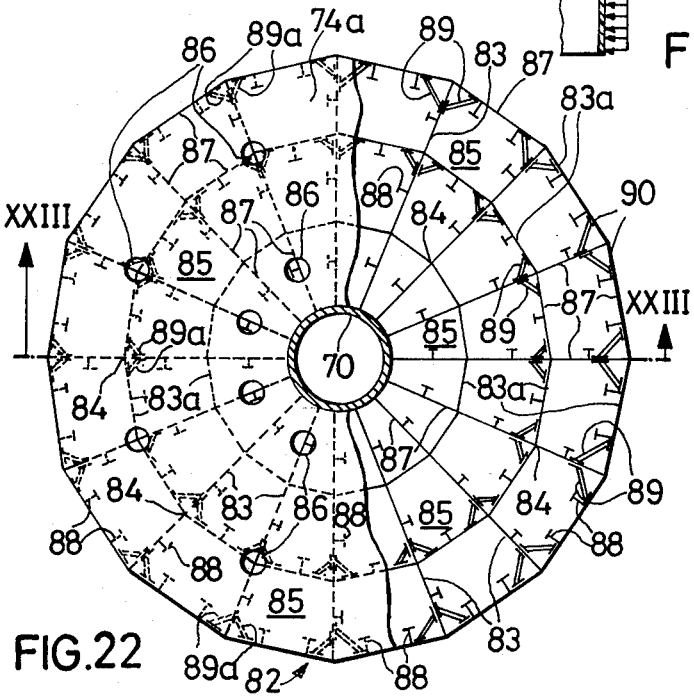
FIG. 22 is a partly sectioned top-plan view of FIG. 23.

FIGS. 22 and 23 show that the pad need not be articulately connected with the spacing element 70, but could also be fixedly connected therewith. In these Figures, the pad is identified with reference numeral 82 and is fixedly mounted on the lower end region of the element 70, for instance by being welded thereto. A portion 81 of the element 70 projects downwardly below the pad 82. The portion 74*a* of the pad 82 actually is the portion that corresponds to the pad 74 of the preceding Figures; it has an upwardly conical configuration and resembles a downwardly open hood or the like. The lower side of this hood-shaped member 74*a* is provided with a plurality of relatively high ribs 83 which are uniformly distributed and extend radially, and similar ribs 83*a* which are arranged concentrically with reference to the element 70 and form junctures 84 with the ribs 83. The ribs 83 and 83*a* therefore form with one another a honeycomb structure having downwardly open cells 85 which are bounded by the downwardly facing edges of the ribs. These edges are located on an imaginary substantially conical surface. The member 74*a* is provided with a plurality of circular openings 86 which are located above the junctions 84 or, insofar as the radially inner cells 85 are concerned, above the ribs 83. These openings 86 permit water to be expelled from the cells 85 when the pad 82 is pressed into the ocean bottom and the lower edges of the ribs 83, 83*a* penetrate the ocean bottom and thus entrap water that is present in the cells 85. The provision of the openings 86 premits this entrapped water to escape and therefore facilitates the penetration of the pad 82 into the ocean bottom. The vertical height of the pad 82 is approximately equal to the difference between the radius of the member 74*a* and that of the element 70.

Figure 24:
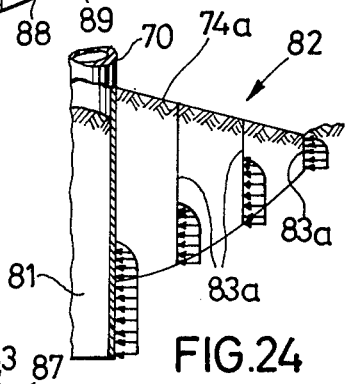
FIG. 24 is a fragmentary diagrammatic view analogous to FIG. 23, illustrating thrust distribution in the embodiment of FIGS. 22 and 23.

There is a possibility that the free downwardly facing edges of the ribs 83 and 83*a* might bend over upon encountering the ocean bottom, thereby either making it more difficult to penetrate the ocean bottom or possibly even causing severe damage or destruction of the pad 82. In order to avoid this, the portions 87 of the ribs 83 and 83*a* which are located intermediate the junctions 84 are reinforced with profiled bars 88 extending parallel to the element 70; at the outermost ribs 83*a*, the profiled bars 88 are doubled up, that is they are arranged in pairs. Additional reinforcements are provided in the lower outer corners of the cells, with the exception of the innermost ring of cells 85, in order to reinforce the region of the ribs 83 and 83*a* which must resist thrust forces that are indicated by the arrows in FIG. 24. These additional reinforcements are in form of supporting pipes 89 and 89*a* which bridge the corners of respective adjacent ribs and which engage with the opposite ends respective reinforcing strips 90 which are welded to the ribs.

The thrust forces (see FIG. 24) which can act upon the rig and therefore upon the pads 82 from all circumferential directions, act particularly strongly about those portions of the respective pads 82 which in the direction of thrust are the outward portions. These portions are identified by the double lines in FIG. 14 (note that in FIG. 14 the pads 82 are shown to be partially surrounded by a curved line which identifies the portions in question) are therefore additionally reinforced in that in these portions the supporting pipes 89 are longer than the supporting pipes 89*a* at the opposite side of the pad 82, and/or in that the number of the pipes 89 in a plane parallel to the element 70 is increased as opposed to the opposite side of the pad 82. By making the pipes 89 longer than the pipes 89*a*, they support the respective ribs 83 and 83*a* over a wider range.

When the pad 82 penetrates into the ocean bottom, it will be the ribs 83 and 83*a* which so penetrate and the penetration continues until the member 74*a* engages the ocean bottom and therefore offers a substantially greater resistance to further penetration than did the ribs 83 and 83*a*. The pad 82 is then able to offer very high resistance to transversely acting thrust forces, that is to forces acting in a horizontal or substantially horizontal direction; this resistance is further improved in that after the formation of the foundation, as described earlier, is completed and the full weight of the rig rests upon the foundation, or rather the individual foundations which are associated with the respective floats 5, the friction between each foundation and the ocean bottom reaches very high values and, therefore, provides an additional safeguard against lateral displacement.

FIG. 25 shows an embodiment which is somewhat analogous to the one in FIG. 19; here, again, the legs 2 each have one of the floats associated with them, and each of the framework structures 1*b* has three of the legs, so that the three floats of each framework structure 1*b* are again arranged in a group as in the embodiment of FIG. 19. However, as this arrangement is the same as in FIG. 19, only one of the floats 5 is shown in the embodiment of FIG. 25. In this embodiment, the floats 5 may be provided with individual skirts 6, as shown, or else with a common skirt 6*a* as in the embodiment of FIG. 19. In FIG. 25, a spacing element 70*a* is provided which corresponds to the element 70 of FIGS. 19–24. Additionally, the embodiment of FIG. 25 has spider-like structures 8 which communicate with the pipes 11 and which prior to being placed into operation are located closely beneath the respective float 5. They can be lowered by lowering the pipe 11 in the manner described previously; the outlet openings 10 serve to discharge high-pressure jets of water which flush away silt or mud from the ocean bottom, also in the manner described previously, in order to prepare the ocean bottom for pouring foundation-forming material onto it in order to provide the foundation 76. The portion of each spider-like structure 8 surrounding the associated pipe 11 constitutes a separate flushing device 91 in form of the head 92 of a tubular element 93 which is represented by a pipe 94 that is telescoped into the pipe 11. This pipe 94 can be telescoped downwardly. The head 92 is provided with nozzle openings 95 through which high-pressure jets of water can be expelled to form a depression in the ocean bottom; this can be facilitated by turining the device 91, and the action of the jets of water will then form in the ocean bottom a depression 96. The openings 85 are advantageously so oriented that the water jets have a slight upward component of movement; they may also be arranged vertically spaced from one another, rather than circumferentially spaced as shown in FIG. 25; the purpose of these measures is to prevent the agitated silt or mud from dropping back into the depression 96 and closing it up again.

Once the depression 96 is formed, the foundation-forming material for the foundation 76 is supplied in the manner described earlier, i.e., through the legs 2 and the openings 7 in the bottom wall 9 of the respective float 5, so that it can drop onto the ocean bottom beneath the float 5. In so doing, it will also drop into the depression 96 since the spider-like structure 8 is composed of radially or substantially radially extending tubular members between which there is sufficient room for the material to pass downwardly into the depression 96. When thereupon liquid concrete is injected into the foundation-forming material 76 via the spider-like structure 8 (and, if desired, also via the head 92) the concrete will harden and unite the mass of foundation-forming material 76 into a solid block. Since a portion of this block is located in the depression 96, and another portion is located in the upwardly conical recess formed beneath the wall 9 of the float 5, the foundation is in effect provided with a pair of projections, plugs or dowels which anchor it to the ocean bottom and to the float 5, respectively, in the manner shown in FIG. 25.

FIG. 26 shows that the spacing element 70 is integrated with the framework structure 1*b* and provided at its lower end with the pad 74 that has been described with reference to FIGS. 19–21. This spacing element 70 is hollow and a pile-like element 93 is slidably accommodated within it. Also accommodated within the element 70 is a weight or gravity ram 97 which is located above the element 93 and which is connected via a rope, cable or the like 98 with a location (for example, the platform 3) where equipment is provided for raising the ram 97 by taking up the element 98. When the element 98 is then subsequently suddenly released, the ram 97 will drop under the influence of gravity onto the other end of the element 93 and will pound the lower end of the latter into the ocean bottom. FIG. 27 shows that the ram 97 advantageously has a star-shaped cross section so that the resistance to its movement in the water-filled element 70 is small.

FIG. 29 shows that in lieu of the elements 93 and 97, the spacing element 70 may accommodate a drilling rod 99 having a drilling head 100 that is provided with slits 101. The rod 100 is hollow to permit water to be forced through it and the slits 101 in order to flush the area surrounding the head 100 and facilitate drilling.

In fact, both of the elements 93 and 99 are hollow. The purpose is not only to supply water under high pressure, as in the case of the element 99, but also to permit foundation-forming material 102 to be accommodated in them (compare FIG. 28) which can be jettisoned in order to form the foundation 76*a* for the pad 74. The lower opening 103 at the lower end of the spacing element 70 is closed by a cover 105 if the element 70 accommodates the pile element 93 which itself has at its lower end an opening 104; the cover 105 is mounted on the element 70, as indicated in FIG. 28, for example by a relatively weak welded seam. It will be pushed off when the weight 97 is allowed to impact the element 93 and push the same against the cover 105, whereupon the foundation-forming material 102 can fall out of the element 93 onto the ocean bottom before the pad 74 engages the latter. If the drilling rod 99 is accommodated in the element 70, the rod 99 has an opening 104*a* in its circumferential wall in the vicinity of the head 100, and this opening is covered by the circumferential wall of the element 70 as long as the rod 99 is withdrawn into the element 70 to an extent sufficient for the wall of the element 70 to overlap the opening 104*a*. Evidently, once the rod 99 moves downwardly beyond the lower opening of the element 70, the foundation-forming material can fall out of the opening 104*a*.

The embodiments of FIGS. 26–29 have the purpose of anchoring the rig against lateral displacement on the ocean floor. For this purpose, either the element 93 is pounded to some extent into the ocean floor, as indicated in FIG. 26, or the rod 99 is used to drill into the ocean floor so that the head and possibly a portion of the rod 99 become embedded therein. In either case, the element 93 and 99 are left in place in this position in which they penetrate partly into the ocean floor. Of couse, in operation these elements must extend downwardly beyond the lowest ends of whatever elements may come in contact with ocean floor, that is the lowest ends of the floats 5, the lowest ends of the spacing elements 70 or 70*a*, or the spider-like structures 8.

If the floats 5 are considered in the manner described with respect to FIG. 8, then an element 31*a* can be used which corresponds to the element 93 of FIG. 26, but is located laterally of the respective leg 2 and adapted to be driven into the ocean bottom by means of a non-illustrated arrangement, for example again a gravity ram. In such a case the element 31*a* is located in a sleeve 32 of the leg 2, which extends with its upper end in sealing relationship through the cover 50 and at its lower end constitutes a portion of the connection 17.

As pointed out earlier, the embodiments in FIGS. 13–29 have been described with reference to a drilling rig having a plurality of tiltable pivotable framework structures 1*b*. In such a rig, which is floated in collapsed horizontal condition to the site of installation, whereupon the legs are pivoted downwardly with respect to the plaform 3, separate devices for stabilizing the attitude of the rig are not necessary. If, however, the rig is of the rigid type, such as for example shown in FIGS. 1 and 30, it is advisable to provide attitude-controlling or maintaining arrangements which prevent tilting and possible tumbling over of the rig.

FIGS. 30 and 31 show one such possibility wherein a plurality of units 106 are mounted on the platform 3; these units 106 are in form of jet engines 107 which are symmetrically arranged about the vertical axis of the rig. The discharge nozzles of the engines 107, which may be single acting and which may also be located at different vertical planes, are pivotable in horizontal planes so that they can produce a thrust in any desired direction. The setting of the thrust direction is effected by a computer which receives signals for the attitude maintenance. The computer may, incidentally, also control the rate of descent, that is the flooding of the floats 5. The signals for the attitude maintenance orginate in an attitude measuring system which produces such signals only when the rig has tilted beyond a slight permissible angle. Auxiliary devices are then used to pivot all of the jet engines 107 in such a direction that they produce thrust in a direction requisite to return the rig to fully upright position. The computer, the attitude measuring system and the auxiliary devices for pivoting the jet engines 107 have not been illustrated because they do not form a part of the present invention and are, in any case, well known in other fields so that they can be readily identified by those skilled in the art.

The effectiveness of the devices 106 can be further enhanced by providing additional devices 108 at the lower end of the rig. These devices also produce thrust which may be coordinated by the computer with the thrust produced by the jet engines 107. The devices 108 are here shown in form of eight drive units 109 each having a ship's propeller 110. These drive units 109 are also arranged symmetrically about the upright axis of the rig and each of them is horizontally pivotable through somewhat more than 180° . The propellers 110 may be adjustable.

FIG. 32 illustrates an alternative to the use of the devices 108. In lieu of those devices, it is also possible to use gas generators 111 each of which is associated with one of the floats 5. The gas generators 107, as well as the devices 108, can be made recoverable simply by mounting them on ropes or cables extending to the platform or to an auxiliary ship, so that they can be pulled back up to the surface when the rig is installed on the ocean bottom and they are disconnected from the rig, for example by divers.

Gas generators of the type illustrated and designated by reference numeral 111 in FIG. 32 are already known; they combust two components and very rapidly produce gases which flow into the interior of the respective float 5 through the inlet 112, increasing the pressure in the interior very rapidly. The ballasting water which previously has entered the float 5 during the descent of the rig, is expelled out of the float 5 through the openings 113 by the generated gases, so that float 5 now has its buoyancy increased again. At a side of the rig which is opposite the location where the float 5 having the gas generator 111 is located, one or more of the floats 5 have at the same time their interior pressure suddenly reduced, for example by withdrawing a closure member 114 which is provided on their associated leg 2 in the region of the cover of the float 5 and which closes the cross section of the leg 2 until it is withdrawn. When the closure member 114 is withdrawn to open the opening 15 and thus communicate the interior of the float 5 with the leg 2 and therefore with the atmosphere above the surface of the ocean, the entrapped air in the float 5 which was previously being compressed by the incoming ballasting water, can rapidly escape, thus permitting a quick inflow of additional ballasting water through the openings 113 and decreasing the buoyancy of the float 5. The movement of the closure member 114 may be effected by means of a pneumatic cylinder and piston unit 116. Of couse, each float having the closure member 114 may also be provided with the gas generator 111, and vice versa. By operating them in the manner described above, one or more floats at one side of the rig (at the side towards which the rig is tilting) may be given increased buoyancy and at the opposite side one or more floats may be given decreased buoyancy, thus aiding in the righting of the rig, that is the restoration of the rig to upright position. The operation of the gas generators 111 and the closure 114 may also be controlled by the computer. It is advantageous if the elements 111 and 114, as well as the devices 108, can be disconnected from the computer, so that the computer can be used to operate only the jet engines 107 by themselves, if this should be desirable for some reason.

In connection with the gas generators 111, it should be pointed out that they have an additional function, namely to produce a pressure equalization in the interior of the respective float as the pressure of the ocean water acting upon the float from the exterior becomes increasingly greater during progressive descent of the rig in the ocean.

Figures 33, 34:
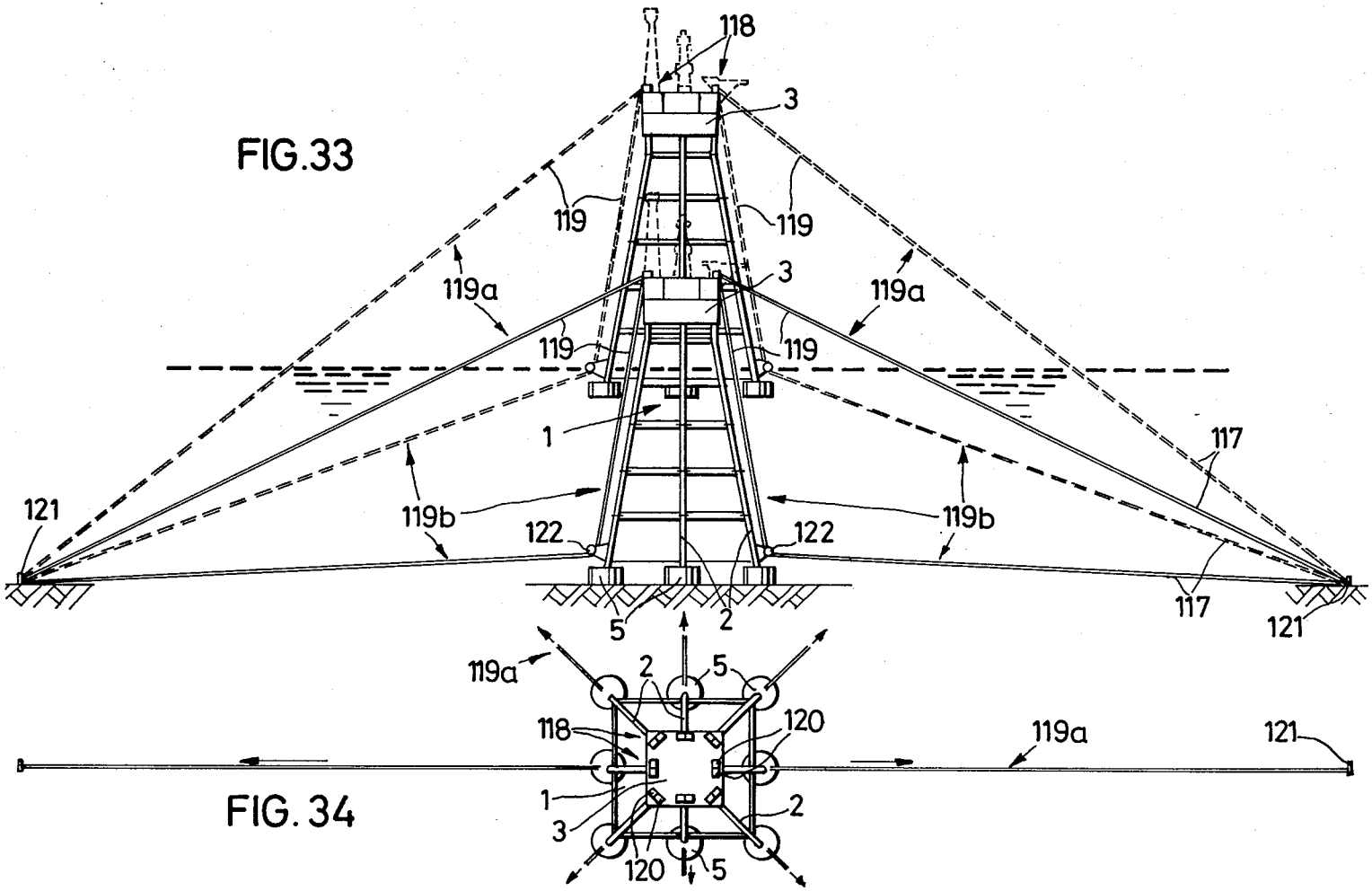
FIG. 33 is a diagrammatic side view illustrating still an additional embodiment of the invention.
FIG. 34 is a top-plan view of FIG. 33.

FIGS. 33 and 34 illustrate an embodiment of a rigid rig wherein the attitude stabilization is effected by means of ropes or cables 117. The rig is shown in the upper position in which it floats on top of the ocean in broken lines, and in its ocean-bottom anchored position in solid lines. Eight mooring winches 118 are mounted on the platform 3 arranged symmetrically about the vertical axes of the rig; these winces 118 are controlled in their operation by the aforementioned computer and are capable of maintaining the ropes 117 at a preselected tension to maintain the attitude of the rig stable, independently of wave action, thus assuring that uncontrollable stressing of the ropes 117 is avoided. Each when 118 has associated with it a set 119 of ropes which is subdivided into two groups **119*a* and 119*b*, and wherein each group in turn has two of the ropes 117 (only one rope is shown for each group to facilitate illustration). The groups 119*a* and 119*b* can be independently taken up and paid out on respective individual drums 120 of the winches 118. The free ends of the ropes 117 are mounted at respective anchoring points 121 which are secured on the ocean bottom at eight locations surrounding the site at which the rig is to be mounted on the bottom. The spacing of the locations 121 from the rig is substantial, and the arrangement of the locations 121 with reference to one another is so chosen that the tensioned sets 119 will extend in a star-shaped configuration and that if their upper ends were extended upwardly, they would intersect one another in a point above the plaform 3**.

In order to produce the desired stabilizing forces upon the upper end of the rig, the groups **119*a* extend directly from the platform 3 to the anchoring locations 121. To produce the lower stabilizing forces, the groups 119*b* are first trained about rollers 122 which are mounted downwardly of the respective winch 118 on the rig, in the vicinity of the respective floats 5; from the rolls 122 the cables then also extend to the anchoring locations 121**.

The paying out and taking up of the groups **119*a* and 119*b* by the winces 118 is so controlled that only those groups 119*a* and/or 119*b* are stressed to a greater degree than the other ones, which are needed to stabilize the attitude of the rig. If, for example, the rig were to tilt towards the right in FIG. 33, then the groups 119*a* and/or 119*b* extending from the rig towards the left-hand side of FIG. 33** would be tensioned further by taking up some of their ropes onto the respective winches, thus returning the rig to upright position.

Figure 35:
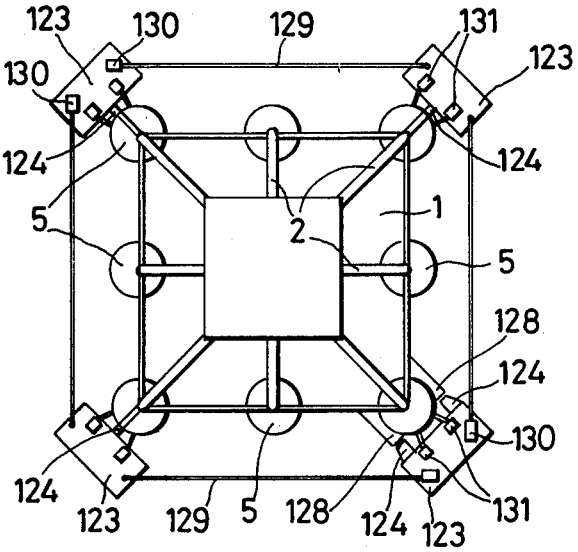
FIG. 35 is a top-plan view illustrating an additional embodiment of the invention.
Figure 36:
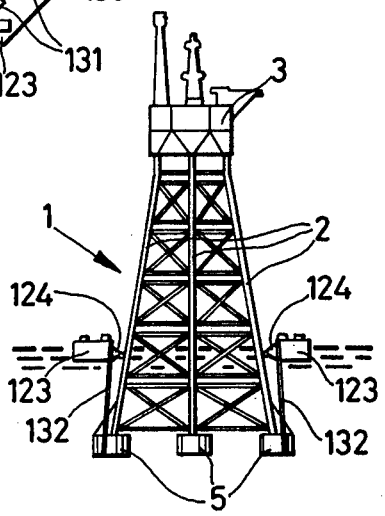
FIG. 36 is a side view showing a rig according to the present invention in a position in which it has been lowered part-way to the ocean bottom.
Figure 37:
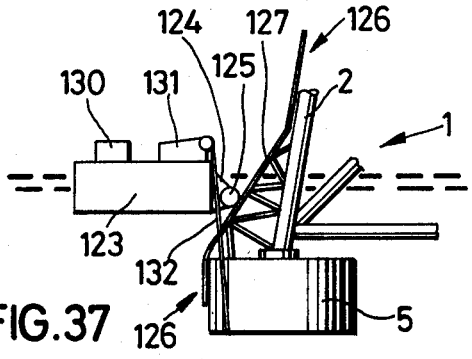
FIG. 37 is a diagrammatic enlarged-scale side view showing a detail of the lower region of the rig in FIG. 36.

Finally, FIGS. 35–37 illustrate a further embodiment which shows that the attitude stabilization can also be effected by means of auxiliary float devices 123 which are arranged at each corner of the upwardly convergent framework structure 1 of the rig, and which are maintained at a slight distance from the floats 5 by means of spacer devices 124. Three of the auxiliary float devices 123 are each provided with a single spacer device 124 at their middle, which has a profiled roller 125 by means of which it engages a guide rail 126 extending upwardly from the respective float 5. Each guide rail 126 has a transition portion 127 which leads from the respective float 5 to the leg 2 associated therewith (compare FIG. 37) and the rail then extends along the leg 2 in upward direction to the vicinity of the platform 3. The rollers 125 prevent lateral shifting of the devices 123 with reference to the framework structure 1.

The fourth one of the devices 123 is provided with two of the spacers 124 which are respectively located to the left and to the right of the associated leg and whose rollers 125 each engage one of the guide rails 126. All of the guide rails are mounted on the rig, of course, but the guide rails associated with the device 123 are mounted on abutments 128 of the framework structure 1 and also extend upwardly as already described; they also have the transition portion that is shown in FIG. 37.

The respectively adjacent ends of the devices 123 are connected with one another by means of one or more ropes or cables 129, the free rope end being secured to one of the devices 123 and the other rope end extending to the drum of a mooring winch 130 which is mounted on the adjacent device 123. In this arrangement, each of the devices 123 carries two mooring winches 130. All of the devices 123 are thus firmly held in position around the framework structure 1 and are also located adjacent the respective legs 2, from which they cannot move away since the abutments 128 in cooperation with the tension of the ropes 129 prevent such movement.

Each of the devices 123 is further provided with two spaced additional mooring winches 131 having ropes or cables 132 which extend to the bottom of the respective float 5 and are there secured to the right and to the left of the associated leg 2, respectively. Since even in the immersed condition of the rig the floats 5 support the weight of the rig, the ropes 132 will be stressed—and then only for stabilizing purposes—if the rig tends to tilt out of its upright position. The devices 123 will always be pressed against the framework structure 1, because during each phase of the descent of the rig towards the ocean bottom, the mooring winches 130 will exert a constant pressure upon the ropes 129. The control of the operation of the mooring winches 130 and the mooring winches 131 is coordinated, again by means of a computer. Evidently, as the rig descends farther and farther to the ocean bottom, the devices 123 will rise higher and higher with respect to the rig or, more accurately, the devices 123 will float on the surface of the ocean, and the rig will descend with reference to them. Since the mooring winches 130 exert a constant tension upon the ropes 129, the devices 123 will always be urged into contact with the framework structure 1, despite the fact that the framework structure 1 is upwardly convergent.

After the structure is secured on the ocean bottom, the devices 123 can be readily removed and reused for other applications.

It will be understood that each of the elements described above, or two or more together, may also find a useful application in other types of applications differing from the type described above.

While the invention has been illustrated and described as embodied in an offshore drilling rig, it is not intended to be limited to the details shown since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; means for communicating the interior of each float with the interior of the associated leg and with the region beneath the bottom wall of said float, said communicating means comprising an upper port means for communicating the interior of the respective float with the associated leg, and lower port means in the bottom wall of the respective float, and wherein each leg has a portion extending into the respective float, and said upper port means comprises three equiangularly spaced openings in said portion; an open-ended tubular member received in said portion with clearance; a plurality of elastic sealing elements in said clearance intermediate the respective openings, at least one of said sealing elements being inflatable to thereby exert pressure upon said portion and tubular member and also urge the latter into sealing engagement with the other sealing elements; and remote-controllable means connected with said tubular member for effecting axial movement of the same within said portion.

2. A rig is defined in claim 1; and further comprising an air line extending upwardly of said rig from an upper region of the respective float; and blocking means for blocking said air line.

3. A rig as defined in claim 1; and further comprising a flooding line extending from a lower region of the respective float to the exterior thereof; and means for connecting said flooding line to a source of water so as to ballast the respective float.

4. A rig as defined in claim 3, wherein said flooding line extends along the respective leg upwardly to the region of said platform; said connecting means comprising a plurality of vertically spaced connectors for connecting said flooding line to said source.

5. A rig as defined in claim 1; further comprising a flange on each of said legs and connecting the same rigidly with the respective float.

6. A rig as defined in claim 1; further comprising anchoring means provided on said bottom walls of the respective floats.

7. A rig as defined in claim 6, wherein said anchoring means comprises downwardly extending spikes, ropes and anchoring elements.

8. A rig as defined in claim 1, wherein said lower port means are dimensioned to permit passage of auxiliary underwater equipment which is to be deployed and recovered from said platform through the respective leg.

9. A rig as defined in claim 1, wherein said framework structure comprises cross-braces at least some of which are tubular, respective ones of the tubular cross-braces being connected and communicating with one another and with said legs.

10. A rig as defined in claim 9, wherein each of said legs is composed of an outer pipe having its lower end located at the associated float, an inner pipe rigidly anchored within said float and extending with clearance into a lower end portion of said outer pipe, and a seal in said clearance, said inner pipe being adjustable relative to said outer pipe.

11. A rig as defined in claim 1, wherein said framework structure comprises upright supports and cross-braces; and wherein said legs are mounted on said upright supports for longitudinal displacement relative to the same.

12. A rig as defined in claim 1; further comprising a member mounted on said framework structure in the upright direction of the same and having a head portion, said member being mounted for movement in said upright direction to and from a position in which said head portion extends downwardly of the respective float and penetrates the ocean bottom.

13. A rig as defined in claim 1; further comprising means mounting at least a portion of said dispensing means for movement in direction downwardly beyond said bottom wall of the respective float, for penetration into the ocean bottom.

14. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; means for communicating the interior of each float with the interior of the associated leg and with the region beneath the bottom wall of said float, said communicating means comprising an upper port means for communicating the interior of the respective float with the associated leg, and lower port means in the bottom wall of the respective float; and a jettisonable plate fluid-tightly closing said lower port means.

15. A rig as defined in claim 14, wherein each of said legs is provided with a sealable aperture adapted to be located below water lever when said rig is supported on the ocean bottom.

16. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; and means for communicating the interior of each float with the interior of the associated leg and with the region beneath the bottom wall of said float, said dispensing means comprising a spider of tubular members each having respective ones of said apertures and a conduit connecting the interior of said tubular members with the region of said platform, wherein said spider comprises a central distributor coaxial with the respective leg, said tubular members extending radially outwardly from said distributor and being divided into a first group having the apertures thereof facing upwardly and a second group having at least some of the apertures thereof facing downwardly and outwardly, and means for raising and lowering said groups relative to said bottom wall.

17. A rig as defined in claim 16, wherein said conduit is connected with said groups, and said means for raising and lowering effects raising and lowering of said conduit.

18. A rig as defined in claim 17, said conduit extending axially through the respective leg; and further comprising mounting means mounting said conduit for turning movement in and relative to the respective leg.

19. A rig as defined in claim 17, wherein said conduit is a structural member dimensioned to temporarily support a portion of the weight of said rig.

20. A rig as defined in claim 17, wherein the tubular members of one of said groups communicate withe said central distributor; further comprising an additional distributor located within said central distributor and communicating with the tubular members of the other of said groups, and an additional conduit extending from said additional distributor within the first-mentioned conduit to the region of said platform.

21. A rig as defined in claim 16, wherein said spider is located in said float and said tubular members have end portions sealingly received in respective openings of said bottom wall and provided with said apertures, said conduit having a portion located adjacent the lower end of the associated leg within said float and provided with a distributor which communicates with said tubular members.

22. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same framework structure comprising at least one upright structural member having a lower end portion which projects downwardly below the lower sides of said floats; said floats being of upwardly convergent configuration; dispensing means provided at the respective floats and having a plurality of apertures located below the bottom wall of the respective float for dispensing of flowable material; means for communicating the interior of each float with the interior of the associated leg and with the region beneath the bottom wall of said float; and an ocean-bottom engaging pad at said lower end portion, and a swivel connection mounting said pad on said lower end portion.

23. A rig as defined in claim 22, wherein said pad has a hole, and said lower end portion is received in said hole with radial play and includes a pair of vertically spaced abutments which are respectively located above and below said pad.

24. A rig as defined in claim 22, wherein at least said lower end portion is hollow and provided at its lower end with an opening.

25. A rig as defined in claim 24; and further comprising means for closing said opening of said lower end portion.

26. A rig as defined in claim 24, wherein said opening is located below said pad, and said lower end portion is provided with a further opening located above said pad.

27. A rig as defined in claim 22, wherein said floats are of domed shape.

28. A rig as defined in claim 22, wherein said floats are of domed shape and have a circumferential walls formed with upwardly convergent raised ribs.

29. A rig as defined in claim 22; said ocean-bottom engaging pad being rigidly mounted on said lower end portion.

30. A rig as defined in claim 22, wherein said structural member is hollow; and further comprising an elongated tubular ocean-bottom penetrating member guided within said structural member and having a lower end portion provided with a port, said penetrating member being movable between an upper retracted position in which said port is overlapped and closed by a portion of said structural member, and a lower operating position in which said port is exposed and said lower end portion partially penetrates into the ocean bottom.

31. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; means for communicating the interior of each float with the interior of the associated leg and with the region beneath the bottom wall of said float; and an ocean-bottom engaging pad rigidly mounted on said lower end portion, wherein said framework structure comprises at least one upright structural member having a lower end portion which projects downwardly below the lower sides of said floats, said floats have an upwardly convergent configuration, and said pad has a downwardly facing side provided with raised ribs so that the pad has a honeycomb structure.

32. A rig as defined in claim 31, wherein first ones of said ribs form at least one ring surrounding said lower end portion, and second ones of said ribs extend radially of said ring.

33. A rig as defined in claim 32, wherein said ribs have downwardly directed edges located on the surface of an imaginary cone.

34. A rig as defined in claim 33, wherein said first and second ribs intersect; further comprising tubular reinforcing members engaging said ribs in the region of said edges and in the region where the ribs intersect, and profiled reinforcing members extending parallel to said lower end portion and engaging said ribs intermediate said tubular reinforcing members.

35. A rig as defined in claim 34, wherein said pad has two halves, and wherein the number of said tubular reinforcing members in one of said halves exceeds the number of tubular reinforcing members in the other of said halves.

36. A rig as defined in claim 34, wherein said pad has two halves, and wherein the tubular reinforcing members in one of said halves are longer than those in the other of said halves.

37. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; means for communicating the interior of each float with the interior of the associated leg and with the region beneath the bottom wall of said float; and ocean-bottom penetrating means having a portion adapted to extend downwardly beyond said floats and at least partially penetrate into the ocean bottom, said portion being hollow and adapted to receive pressure medium from an upright conduit of said framework structure, and said portion having discharge nozzles which discharge pressure medium in directions which are inclined to the longitudinal axis of said conduit at angles different from 90°.

38. A rig as defined in claim 37, wherein said penetrating means is turnable about an upright axis.

39. A rig as defined in claim 37, said penetrating means comprising an elongated upright rotatable drill rod having a lower end section provided with a drill head.

40. A rig as defined in claim 39, wherein said pressure medium is channelled to flush said drill head.

41. A rig as defined in claim 37, said penetrating means comprising an elongated upright pile member, and a ram for impacting an upper end of said pile member.

42. A rig as defined in claim 37, wherein the respective float has an interior sleeve projecting upwardly from its bottom wall; and wherein said pile member has a lower section slidably received in said sleeve and an upper section slidably mounted on and guided by the respective leg.

43. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; and means for communicating the interior of each float with the interior of the associated leg and with the region beneath the bottom wall of said float, wherein said floats are angularly spaced about the upright axis of said framework structure, each of said floats having an exposed opening for admission of ambient water, at least one of said floats being adapted to have its internal pressure increased so that some of the admitted water is temporarily expelled therefrom, and at least a diametrically opposite float being adapted to have its internal pressure decreased so that additional water is temporarily admitted thereinto.

44. A rig as defined in claim 43; further comprising gas-generating means in said one float; and means for selectively connecting said opposite float with the atmosphere.

45. An off-shore drilling rig, comprising at least one upright framework structure provided with an upper platform and with a plurality of downwardly extending hollow legs, each leg having a lower end and an upper end through which its interior is accessible from said platform; a plurality of ballastable floats together furnishing at least part of the buoyancy required to maintain the framework structure afloat preliminary to anchoring on the ocean bottom, each of said floats being mounted at one of said lower ends and having a bottom wall and a deformable skirt surrounding said bottom wall and depending downwardly beyond the same; dispensing means provided at the respective floats and having a plurality of apertures located below the bottom wall of the respective float for dispensing of flowable material; means for communicating the interior of each float with the interior of the associated leg and with the region beneath the bottom wall of said float; and orientation-maintaining means for maintaining said framework structure in floating upright orientation on the water preparatory to lowering said framework structure to a position in which said legs are supported by the ocean bottom.

46. A rig as defined in claim 45, wherein said orientation-maintaining means comprises buoyancy bodies connected with said framework structure for relative displacement in the upright direction thereof while remaining in contact therewith; first connecting means connecting said buoyancy bodies with one another circumferentially of said framework structure and urging said bodies into contact therewith; second connection means connecting each of said bodies to a lower region of said structure; and abutment means for fixing the relative position of at least one of said bodies with respect to the transverse direction of said framework structure.

47. A rig as defined in claim 46, said framework structure having upright guide rails; and said buoyancy bodies each having at least one spacing portion provided with an engaging portion which slidably engages a respective one of said guide rails.

48. A rig as defined in claim 47, wherein said guide rails are mounted to extend immediately proximal to said framework structure and floats.

49. A rig as defined in claim 47, wherein said framework structure has four corners, three of said corners being each provided with one of said guide rails, and one of said corners being provided with said abutment means and with two of said guide rails mounted symmetrically with reference to said fourth corner.

50. A rig as defined in claim 48, wherein said engaging portion is a roll.

51. A rig as defined in claim 46, wherein said first connecting means comprises lines connecting adjacent ends of circumferentially adjacent ones of said buoyancy bodies.

52. A rig as defined in claim 51; further comprising a winch for shortening said lines.

53. A rig as defined in claim 52; further comprising an additional winch on one of said buoyancy bodies; and wherein said second connecting means comprises mooring lines connected to said winch.

54. A rig as defined in claim 53, wherein both of said winches are jointly controlled in dependency upon the rates of descent of said framework structure in the water.

55. An offshore drilling rig comprising an upright framework structure provided with an upper platform; a plurality of downwardly depending hollow legs, each leg having a lower end and an upper end through which its interior is accessible from said platform; a plurality of ballastable floats contributing to the buoyancy required to maintain flotation of the framework structure preliminary to anchoring on the ocean bottom, each of said floats being mounted upon one of said lower ends and having a bottom wall and a deformable skirt surrounding said bottom wall and depending downwardly beyond the same; spacer means connected to the framework structure and projecting downwardly beyond the floats for transmitting the impact of contact between the rig and the ocean bottom directly to the framework; a flooding conduit communicating with a lower region in the respective floats and selectively connectable to a source of liquid; an air line extending upwardly towards the surface from an upper region of the respective floats; means located between said spacer means and floats for downwardly extruding pressurized medium so that silt and mud is flushed from the ocean bottom.

56. A rig as defined in claim 55, wherein each bottom wall converges conically upward and is provided at its highest point with an outlet covered by a displaceable plate so that the float serves as a medium for the extrusion of foundation-forming material ejected through the lower end of the respective hollow legs upon displacement of the plate to an open position.

57. A rig as defined in claim 55, wherein each float is protected by a surrounding deformable skirt which is maintained in an upper raised position above the bottom wall during transportation of the rig.

58. A rig as defined in claim 55, wherein said lower ends of said hollow legs have outlets which communicate with the interiors of the respectively associated floats and which are closed by displaceable seals so that, after displacement of the seals, ballast may be poured into the floats.

59. A rig as defined in claim 55, wherein the means for extruding the pressurized medium is a spider-like structure having a plurality of outlets.

60. A rig as defined in claim 55, further comprising a plurality of cross braces connecting said legs.

61. A rig as defined in claim 60, wherein at least some of said cross braces are hollow so that additional buoyancy is provided.

62. A rig as defined in claim 55, further comprising conduits connecting the interiors of the respective floats so that venting and pressurizing of the floats can be effected by merely engaging the air line.

63. A rig as defined in claim 55, further comprising a large ground-contact pad connected to said spacer means comprising at least one spacer through a ball-and-socket-like junction so that the large contact area of the pad reduces contact pressure and the junction permits accommodation of the position of the pad to the ocean bottom.

64. A rig as defined in claim 55, further comprising sleeves which slidably mount said legs upon an independent rigid framework so that compensation can be made for variations in the level of the ocean bottom.

65. A rig as defined in claim 56, further comprising a downwardly projecting anchoring means fitted to a lower part of the conically converging bottom wall so that the anchoring means become embedded in the fountation-forming material.

66. A rig as defined in claim 58, wherein said displaceable seals comprise a closure arrangement located within said lower ends of the respective legs, and lines supporting said arrangement extend upwards to the platform so that manipulation of the lines can raise and lower said closure arrangement relative to the outlets.

67. A rig as defined in claim 66, wherein said closure arrangement comprises inflatable elastically yieldable seals operative for activating said arrangement so that pressure of the inflated seals against said legs and said closing arrangement closes the associated outlets.

68. A rig as defined in claim 59, wherein said spider-like structure comprises a plurality of radiating pipes and a common distributor mounted upon the lower end of a respective hollow leg and connected to said radiating pipes.

69. A rig as defined in claim 68, further comprising means connected to the spider-like structure for rotating and raising and lowering the pipes.

70. An offshore oil drilling rig comprising in combination an upright framework structure provided with an upper platform; a plurality of downwardly depending hollow legs, each leg having a lower end and an upper end through which its interior is accessible from said platform; a plurality of ballastable floats contributing to the buoyancy required to maintain flotation of the framework structure preliminary to anchoring of the rig on the ocean bottom, each of said floats being connected to the lower end of one of said hollow legs and each of said floats having a bottom wall; a deformable skirt surrounding said bottom wall and depending downwardly beyond the same; and thrusting means mounted on said upper platform for generating and applying a physical force so as to prevent tilting of said framework.

71. A rig as defined in claim 70, further comprising a flooding line extending from a lower region of the respective float to the exterior thereof, and means for connecting said flooding line to a source of water so as to ballast the respective float.

72. A rig as defined in claim 70, further comprising a flange on each of said legs and connecting the same rigidly with the respective float.

73. A rig as defined in claim 70, wherein the bottom wall of each float has an upwardly concave lower surface.

74. A rig as defined in claim 70, further comprising a mounting arrangement mounting said skirt on the respective float outwardly spaced from the periphery of the same.

75. A rig as defined in claim 70, wherein said framework structure comprises upright and transverse structural members, and wherein said platform is adjustable with reference to said framework structure.

76. A rig as defined in claim 70, wherein said floats are so dimensioned as to lower said rig into engagement with the ocean bottom when said floats are ballasted.

77. A rig as defined in claim 70, wherein said skirt includes inflatable means adapted to be inflated and to thereby deform said skirt so that a lower marginal portion of the skirt forms a surrounding brim that rests substantially flat on the ocean bottom.

78. A rig as defined in claim 70, wherein said skirt is composed of a plurality of segments.

79. A rig as defined in claim 77, further comprising means mounting said skirt in a rolled-up condition on said float when said inflatable means is in an uninflated condition.

80. A rig as defined in claim 77, wherein said inflatable means comprises a plurality of inflatable elements spaced circumferentially of said skirt; and further comprising an annular pressure-supply conduit surrounding a base region of said flat and connected to said inflatable elements.

81. A rig as defined in claim 80, wherein said inflatable elements extend radially of said annular pressure-supply conduit.

82. A rig as defined in claim 80, wherein said pressure-supply conduit is a supply conduit for supplying compressed air to said inflatable elements.

83. A rig as defined in claim 80, wherein said skirt is heavier than water when said inflatable elements are in uninflated condition, and is higher than water when said inflatable elements are fully inflated.

84. A rig as defined in claim 70, wherein said skirt is of metal-reinforced synthetic plastic sheet material.

85. A rig as defined in claim 80, wherein said inflatable elements comprise hoses and elastic brackets mounting said hoses on said lower marginal portion.

86. A rig as defined in claim 77, further comprising weights secured in the region of a free edge of said lower marginal portion.

87. A rig as defined in claim 70, wherein said thrusting means comprises a plurality of pivotable horizontal-thrust jet engines mounted on said platform and arranged symmetrically about the upright axis of said framework structure.

88. A rig as defined in claim 87, further comprising controlling means for setting directions of thrust of said jet engines.

89. A rig as defined in claim 88, said controlling means comprising a computer, orientation-sensing means connected to said computer for sensing orientation of said framework structure, for generating a signal indicative of a tilted orientation and for transmitting the signal to said computer, and force-applying means connected to said computer and to said jet engines for setting a predetermined direction of thrust of said jet engines in dependence on a transmission of said signal to said computer.

90. A rig as defined in claim 87, wherein said jet engines are reversible-thrust engines.

91. A rig as defined in claim 70, wherein said thrusting means comprises a plurality of pivotable horizontal-thrust jet engines mounted on said platform and arranged symmetrically about the upright axis of said framework, and a plurality of units each composed of a ship's propeller and associated drive mounted on said framework structure at a lower region thereof and also symmetrically arranged about said upright axis.

92. A rig as defined in claim 91, wherein said ship's propellers have adjustable propeller blades.

93. A rig as defined in claim 92, wherein said units are mounted for horizontal pivoting of said propellers and for rotation of said propellers about horizontal axes.

94. A rig as defined in claim 92, wherein said units are mounted for rotation of said propellers about vertical axes.

95. A rig as defined in claim 70, further comprising recoverable first devices supporting the upper region of said framework structure, and recoverable second devices supporting the lower region of said framework device.

96. A rig as defined in claim 70, further comprising buoyancy bodies connected to said framework structure for relative displacement in the upright direction thereof while remaining in contact therewith; first connecting means connecting said buoyancy bodies to one another circumferentially of said framework structure and urging said bodies into contact therewith; second connecting means connecting each of said bodies to a lower region of said structure; and abutment means for fixing the relative position of at least one of said bodies with respect to the transverse direction of said framework structure.

97. A rig as defined in claim 96, said framework structure having upright guide rails, and said buoyancy bodies each having at least one spacing portion provided with an engaging portion which slidably engages a respective one of said guide rails.

98. A rig as defined in claim 97, wherein said guide rails are mounted to extend immediately proximal to said framework structure and floats.

99. A rig as defined in claim 70, wherein said framework structure comprises at least one upright structural member having a lower end portion which projects downwardly below the lower sides of said floats, said floats being of upwardly convergent configuration.

100. A rig as defined in claim 99, further comprising an ocean-bottom engaging pad rigidly mounted on said lower end portion.

101. A rig as defined in claim 100, wherein said pad has a downwardly facing side provided with raised ribs so that the pad has a honeycomb structure.

102. A rig as defined in claim 101, wherein said honeycomb structure has a plurality of internal cells each of which is provided with an aperture communicating with the exterior of the pad.

103. A rig as defined in claim 100, wherein said pad is at least in part of upwardly convergent configuration.

104. A rig as defined in claim 101, wherein first ones of said ribs form at least one ring surrounding said lower end portion, and second ones of said ribs extend radially of said ring.

105. A rig as defined in claim 104, wherein said ribs have downwardly directed edges located on the surface of an imaginary cone.

106. A rig as defined in claim 105, wherein said first and second ribs intersect; further comprising tubular reinforcing members engaging said ribs in the region of said edges and in the region where the ribs intersect, and profiled reinforcing members extending parallel to said lower end portion and engaging said ribs intermediate said tubular reinforcing members.

107. A rig as defined in claim 70, further comprising a member mounted on said framework structure in the upright direction of the same and having a head portion, said member being mounted for movement in said upright direction to and from a position in which said head portion extends downwardly of the respective float and penetrates the ocean bottom.

108. A rig as defined in claim 70, further comprising ocean-bottom penetrating means having a portion adapted to extend downwardly beyond said floats and at least partially penetrate into the ocean bottom, said portion being hollow and adapted to receive pressure medium from an upright conduit of said framework structure, and said portion having discharge nozzles which discharge pressure medium in directions which are inclined to the longitudinal axis of said conduit at angles different from 90°.

* * * * *